US010428515B2

(12) United States Patent
Tang et al.

(10) Patent No.: US 10,428,515 B2
(45) Date of Patent: Oct. 1, 2019

(54) BIM-BASED MODULAR HOUSING BUILT WITH THIN-WALL CHANNEL STEELS

(71) Applicant: HENAN AUSPIC TECHNOLOGY CO., LTD., Zhengzhou, Henan (CN)

(72) Inventors: Ming Tang, Beijing (CN); Qun Wei, Zhengzhou (CN); Lushuang Wei, Zhengzhou (CN); Ziqiao Cheng, Beijing (CN); Qiuye Gaoyang, Zhengzhou (CN)

(73) Assignee: HENAN AUSPIC TECHNOLOGY CO., LTD., Zhengzhou (CN)

( * ) Notice: Subject to any disclaimer, the term of this patent is extended or adjusted under 35 U.S.C. 154(b) by 0 days.

(21) Appl. No.: 15/755,433

(22) PCT Filed: Aug. 24, 2016

(86) PCT No.: PCT/CN2016/096549
§ 371 (c)(1),
(2) Date: Feb. 26, 2018

(87) PCT Pub. No.: WO2017/032309
PCT Pub. Date: Mar. 2, 2017

(65) Prior Publication Data

US 2018/0245331 A1 Aug. 30, 2018

(30) Foreign Application Priority Data

Aug. 25, 2015 (CN) ..... 2015 1 0525764

(51) Int. Cl.
*E04B 1/19* (2006.01)
*E04B 1/24* (2006.01)
(Continued)

(52) U.S. Cl.
CPC ..... *E04B 1/1912* (2013.01); *E04B 1/2403* (2013.01); *E04B 1/40* (2013.01);
(Continued)

(58) Field of Classification Search
CPC ..... Y10T 403/55; Y10T 403/551; Y10T 403/559; E04B 1/1912; E04B 1/2403;
(Continued)

(56) References Cited

U.S. PATENT DOCUMENTS 1,788,096 A * 1/1931 Friedemann ..... A47F 5/04 108/96
2,037,889 A * 4/1936 Doud ..... E04B 1/2403 52/781
(Continued)

FOREIGN PATENT DOCUMENTS

CN 201746938 U 2/2011
CN 102359190 A 2/2012
(Continued)

OTHER PUBLICATIONS

CN First Office Action dated Mar. 9, 2017 as received in Application No. 201510525764.7.

*Primary Examiner* — Brian E Glessner
*Assistant Examiner* — Adam G Barlow
(74) *Attorney, Agent, or Firm* — Maschoff Brennan

(57) ABSTRACT

A building information modeling (BIM)-based modular housing built with thin-wall channel steel can include columns and transverse beams adopt inward-flanging C-section steel or combined square steel arranged by oppositely buckling symmetric inward-flanging C-section steel. The columns and transverse beams are connected to each other together by base connectors, butting connectors, or crossed connectors. The joint is provided with webs, and can be used as a standard connector due to high strength, thereby realizing an internal-external nesting effect. A positioning groove arranged outside the joint and the inward-flanging C-section steel can be nested together in a concavo-convex manner, and then pressed and fastened by a fastening steel
(Continued)

strip, thereby realizing effects of fastening and slippage prevention.

19 Claims, 21 Drawing Sheets

(51) Int. Cl.

| | |
|---|---|
| ***E04B 1/41*** | (2006.01) |
| ***E04C 3/07*** | (2006.01) |
| ***E04C 3/08*** | (2006.01) |
| ***E04C 3/32*** | (2006.01) |
| ***E04C 3/09*** | (2006.01) |
| ***E04C 3/11*** | (2006.01) |
| *E04C 3/04* | (2006.01) |

(52) U.S. Cl.
CPC ..... *E04C 3/07* (2013.01); *E04C 3/08* (2013.01); *E04C 3/09* (2013.01); *E04C 3/11* (2013.01); *E04C 3/32* (2013.01); *E04B 2001/1936* (2013.01); *E04B 2001/1972* (2013.01); *E04B 2001/2406* (2013.01); *E04B 2001/2436* (2013.01); *E04B 2001/2451* (2013.01); *E04B 2001/2457* (2013.01); *E04B 2001/2463* (2013.01); *E04B 2103/06* (2013.01); *E04C 2003/0417* (2013.01); *E04C 2003/0421* (2013.01); *E04C 2003/0426* (2013.01); *E04C 2003/0465* (2013.01); *E04C 2003/0473* (2013.01); *E04C 2003/0491* (2013.01)

(58) Field of Classification Search
CPC ..... E04B 1/40; E04B 2001/2406; E04B 2001/2451; E04B 2001/2457; E04B 2001/2463; E04C 3/09; E04C 3/11; E04C 3/32; E04C 3/07; E04C 3/08; E04C 2003/0473; E04C 2003/0491
USPC ..... 52/653.2, 655.1, 282.2, 848; 403/292, 403/293, 298
See application file for complete search history.

(56) References Cited

U.S. PATENT DOCUMENTS

| | | | | |
|---|---|---|---|---|
| 2,737,268 | A | 3/1956 | Smith | |
| 3,494,640 | A * | 2/1970 | Brown | F16L 37/02 285/115 |
| 3,507,401 | A * | 4/1970 | Hall | A47B 87/0215 211/191 |
| 3,977,800 | A * | 8/1976 | Cassel | F16B 7/0446 403/172 |
| 4,111,577 | A * | 9/1978 | Kiyosawa | F16B 7/0446 403/172 |
| 4,760,682 | A * | 8/1988 | King | E04B 1/2403 52/844 |
| 5,003,741 | A * | 4/1991 | Yeh | A47B 47/0008 312/140 |
| 5,820,289 | A * | 10/1998 | Kern | H02B 1/01 403/231 |
| 6,390,719 | B1 * | 5/2002 | Chan | E04B 1/5806 403/205 |
| 8,667,719 | B2 * | 3/2014 | Kagen | G09F 15/0018 40/607.05 |
| 8,739,491 | B2 * | 6/2014 | Maisch | E04C 3/086 52/588.1 |
| 9,121,433 | B1 * | 9/2015 | Bacon | F16B 37/045 |
| 9,458,619 | B2 * | 10/2016 | Bowron | E04B 1/3483 |
| 9,771,718 | B1 * | 9/2017 | Curtin | E04B 9/067 |
| 2008/0199142 | A1 * | 8/2008 | Beck | G02B 6/4459 385/137 |
| 2013/0055676 | A1 * | 3/2013 | van Walraven | E04C 3/07 52/831 |
| 2016/0177990 | A1 * | 6/2016 | Liu | F21V 17/10 362/249.01 |
| 2017/0314254 | A1 * | 11/2017 | Houghton | E04B 1/1912 |
| 2018/0334793 | A1 * | 11/2018 | Strickland | E04B 2/789 |

FOREIGN PATENT DOCUMENTS

| | | | |
|---|---|---|---|
| CN | 102359191 | A | 2/2012 |
| CN | 202248291 | U | 5/2012 |
| CN | 102888895 | A | 1/2013 |
| CN | 105369898 | A | 3/2016 |
| JP | H08151692 | A | 6/1996 |

* cited by examiner

D–D

BIM-BASED MODULAR HOUSING BUILT WITH THIN-WALL CHANNEL STEELS

FIELD OF TECHNOLOGY

The present disclosure relates to the technical field of housing components built with thin-wall steel structures, in particular to a building information modeling (BIM)-based modular housing built with thin-wall channel steels.

BACKGROUND

A cold-arranged thin-wall steel structure building system is attracting more and more attentions recently due to such characteristics as light self-weight, good seismic performance, various connection modes, adaptability in complex architectural image, less or no wet operation, suitability in industrial optimization design and modular production, short construction period, flexible pattern layout of the housing, less construction wastes, reusability in members and close-to-zero pollution to the environment and is listed as a preferred project in the low-rise buildings and middle and high-rise buildings.

At present, the development and application of a novel high-strength cold-arranged profile steel, especially thin-wall cold-arranged profile steel, become the new frontier in the field of cold-arranged profile steel. However, since cold-arranged thin-wall steel structures in our country have not been enough for the deep processing of product members, a wide range of parts and modular production have not yet reached. Foreign forming technologies are adopted so that very few structural systems with independent intellectual property rights are developed being lack of own brand. With the rapid development of the construction of new rural areas in recent years, the demand for housing with new structures is growing continually and the traditional concept is gradually changing. The steel-framed housings have also gradually developed in rural areas. Since the existing steel-framed housing system structure is in large in weight, long in construction period and high in cost, which is unfavorable to its popularization and application. A patent, entitled by "thin wall steel structure single profile and combined profile and thin wall steel structure housing thereof", granted in 2015, proposes a novel steel structure housing system and the present patent application is to solve the problem of quick installation of the above patent.

Patent Publication No. CN102359191A provides a patented technology "thin-wall steel structure connectors and connection structure thereof" in which a technical solution of rapidly butting the connectors and thin-wall steel profiles by tightly-hooping steel strips is adopted. This solution is suitable for rapid assembly of thin-wall steel structure housing in a short period, which has reasonable structural design and is high in strength without fault. However, the patented technology described above, in the process of putting into operation, has the problems of complex structure and difficulty in manufacturing of the profiles, requirement for special forming equipment and high cost, cannot be well combined with the existing profile forming machine and affects promotion and application thereof. In this patented technology, a tubular or grooved profile sleeves the outside of the connectors, hooping grooves in the connectors are used as anti-slippage fixing centers and the profile is compressed inside the hooping grooves forcibly by the tightly-hooping steel strips. However, in practical use, since the thickness of the thin-wall steel profile is very thin, usually being about 0.3 mm and steps and ridges are present at the edges of bilateral wing plates of hooping grooves, the thin-wall steel profile, after being deformed by the compression of the tightly-hooping steel strips, is easy to damage, thereby causing the strength of the profile to decrease obviously, even the fracture of the entire profile. Furthermore, anticorrosive treatment cannot be conducted to voids arranged after the damage and the problem that the connection structure will be corroded is caused after the rainwater enters the damaged gap. Therefore, the patented technology above has potential safety problems in practical application and needs to be improved.

SUMMARY

The purpose of the present disclosure is to solve the existing problems and deficiencies of the existing thin-wall steel structure connectors and connection structures and is directed to provide a BIM-based modular housing built with thin-wall channel steels, capable of avoiding damage to the connection structure caused by excessive partial pressure and adapting to connection requirement of different profile steels so as to reduce difficulty in processing and lower production costs.

The following technical solution is adopted to achieve the purpose above of the present disclosure.

The BIM-based modular housing built with thin-wall channel steels comprises foundations, columns, beams, walls, a roof plate, doors, and windows, wherein the columns and transverse beams adopt inward-flanging C-section steel or combined square steel arranged by oppositely buckling symmetric inward-flanging C-section steel and the columns and foundations, the columns and transverse beams, adjacent transverse beams, the columns or transverse beams and slant beams, the transverse beams or slant beams and roof plate, and joints of adjacent supports are connected to each other together by base connectors, butting connectors, or crossed connectors.

Each inward-flanging C-section steel comprises a web and a bilateral wing plate of which the edge is provided with an inwardly bent inward flange; the combined square steel comprises two inward-flanging C-section steels which are buckled oppositely and an inner support; the inner support is a web welded in a matched manner inside two C-section steel joints and punched or perforated locating grooves are arranged in the outer surfaces of the two C-section steel joints, respectively; bilateral side-plates of the two C-section steel joints are aligned and there is a gap between the bilateral side-plates, outward-opening relief grooves are arranged in respective web at the gap; an inward flange is arranged at the bilateral wing plate of the inward-flanging C-section steel, respectively; the inward-flanging C-section steel is wrapped outside the inner support and the inward flange is inserted inside the corresponding relief hole in a matched manner; the surface of the inward-flanging C-section steel is provided with rear-pressing grooves which sleeve within the punched or perforated locating grooves in a matched manner; steel strips are bound outside the inward-flanging C-section steel such that the inward-flanging C-section steel is fixed with inner support in a whole; clamping grooves are arranged outside the C-section steel joint at a position corresponding to the web and the steel strip forces the inward-flanging C-section steel to be locally recessed to enter the clamping groove.

Each base connector comprises a base and a connecting joint, one connecting joint is arranged at each of both ends of the butting connectors and the crossed connector is used for fixing at least two connecting joints vertically and slantwise; the connecting joint is arranged by welding at least one horizontal or slant plug, which is groove-shaped, at the sides of the C-section steel joints, the web is welded at the inner sides of the C-section steel joints and slant plug at least at the end position and the punched or perforated locating grooves are arranged at the outside surfaces of the C-section steel joints and slant plug; outward-opening relief grooves are arranged between respective web and bilateral side-plates of the C-section steel joints or the slant plug; and clamping grooves are arranged outside the C-section steel joints and the slant plug at a position corresponding to the web.

Information on a unique name, a unique spatial location, a shape and a material of respective workpiece in a steel structure project, including the information on the unique name, unique spatial location, shape and material of beams, columns and respective connecting joint recorded by BIM information locating pieces, is recorded using the BIM information locating pieces; during the construction, the information included in the BIM information locating pieces on respective workpiece is read by a BIM information scanner to perform connection and welding construction on respective workpiece in the project.

A method for recording the information on the beams and columns by the BIM information locating pieces comprises the following steps of: establishing the BIM information locating pieces with respect to the beams and columns at both ends of the front side of the beams and columns and establishing a left-end BIM information locating piece A and a right-end BIM information locating piece B, respectively, at the position of a beacon, wherein the beacon is located at the center of the BIM information locating piece; and both the left-end BIM information locating piece A and right-end BIM information locating piece B comprise a unique name information record, a size information record and a material information record of a beam or a column, a spatial location information record of the beam or column, name information records of end members of the beam or column as well as name information and location information records of locating connecting plates at the respective side of the beam or column.

The connecting joints of the base connector or butting connector or crossed connector comprise a connecting joint for single thin-wall inward-flanging C-section steel and a connecting joint for dual-thin-wall inward-flanging C-section steel.

The connecting joint for the dual-thin-wall inward-flanging C-section steel is welded with a web in a matched manner at least at both ends inside two C-section steel joints buckled oppositely; and punched or perforated locating grooves are arranged in the outer surfaces of the two C-section steel joints, respectively; bilateral side-plates of the two C-section steel joints are aligned and there is a gap between the bilateral side-plates, outward-opening relief grooves are arranged in respective web at the gap; clamping grooves are arranged outside the C-section steel joint at a position corresponding to the web.

The crossed connector comprises a cross-shaped, T-shaped, K-shaped, L-shaped, V-shaped or a mutually perpendicular three-dimensional coordinate form.

The BIM-based modular housing built with thin-wall channel steels further comprises connectors between thin-wall ingots and top beams, upper and lower fitting surfaces and front and rear webs, wherein there is an included angle between the upper and lower fitting surfaces; lateral edges are arranged at both sides of the upper and lower fitting surfaces and relief grooves are arranged between the front and rear webs and the lateral edges; punched or perforated locating grooves are arranged at the bilateral surfaces of the upper and lower fitting surfaces; and the clamping grooves are arranged outside the bilateral surfaces of the upper and lower fitting surfaces at a position corresponding to the web.

The BIM-based modular housing built with thin-wall channel steels further comprises a blanking holder for extruding a concavo-convex inlaying structure between the inward-flanging C-section steel and the web of respective connector.

The BIM-based modular housing built with thin-wall channel steels further comprises a groove-pressing machine for concavely pressing the inward-flanging C-section steel to enter the clamping groove of respective connector.

The BIM-based modular housing built with thin-wall channel steels further comprises a wrapping machine for fastening the steel strips inside the inward-flanging C-section steel and clamping groove of respective connector.

The BIM-based modular housing built with thin-wall channel steels further comprises stairs and fences.

The BIM-based modular housing built with thin-wall channel steels has the following benefit effects: according to the technical solution of the present disclosure, the inward-flanging C-section steel can be quickly and securely butted, or combined square steel can be quickly and securely butted. The joint is provided with webs, and can be used as a standard connector due to high strength. Since the inward-flanging C-section steel is standard steel, five types of inward-flanging C-section steel according to the standard size exist so as to meet the different structural strength requirements. Relief holes provided at the inner side of the joint are buckled with inward-flanges of the inward-flanging C-section steel to each other and pressed together, thereby realizing an internal-external nesting effect. A positioning groove arranged outside the joint and the inward-flanging C-section steel can be nested together in a concavo-convex manner, and then pressed and fastened by a fastening steel strip, thereby realizing effects of fastening and slippage prevention. The present disclosure has the advantages of reasonable and simple structure, no need for process steps such as welding or riveting and high connection strength and is uneasy to slip off. The problem of damage due to being locally squeezed fails to occur. The purpose of simple and efficient construction can be achieved by the tightly-hooping steel strip. Matching weight-reducing holes can also be arranged in the middle of partial web of respective connector so as to further reduce the self-weight of the connector, thereby reduce the self-weight of the housing.

DESCRIPTION OF REFERENCE SIGNS

Figure 1:
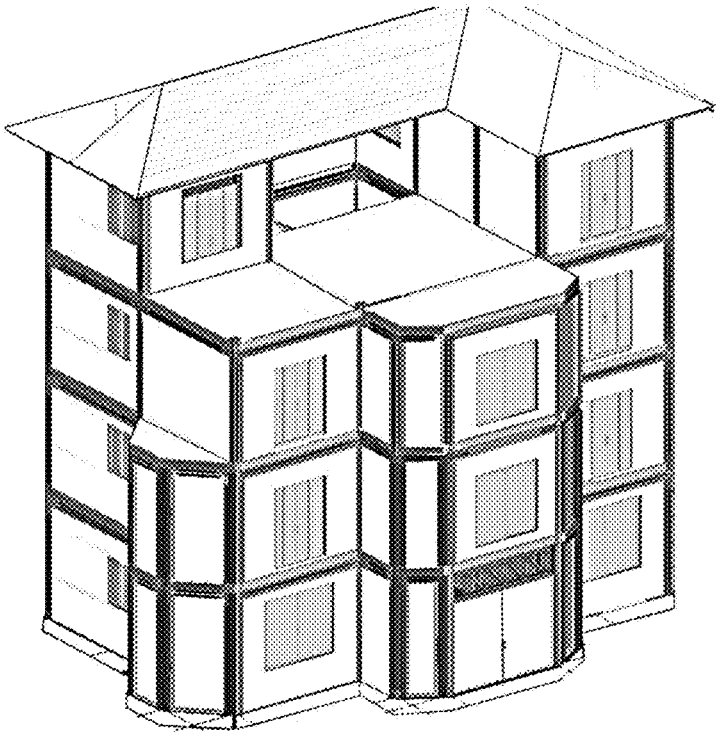
FIG. 1 is a schematic view of the overall structure of a modular housing according to the present disclosure.

A1 butting connector made of single channel steel
A2 butting connector made of dual channel steel
B internal supporting pad
C cross-shaped connecting joint
D four-way connecting joint made of single channel steel for beam/columns
E1 three-way connecting joint made of single channel steel for beam/columns
E2 three-way connecting joint made of dual channel steel for beams/columns
F T-shaped connecting joint made of single channel steel
G1 L-shaped connecting joint made of single channel steel
G2 L-shaped connecting joint made of dual channel steel
H connecting joint made of single channel steel for a ridge
I1 connecting joint made of single channel steel for the ridge and top beam
I2 connecting joint made of dual channel steel for the ridge and top beam
J1 six-way connecting joint made of single channel steel mutually perpendicular to each other
J2 six-way connecting joint made of dual channel steel mutually perpendicular to each other
K connecting joint for the ridge and beams;
L slantwise crossed connector
M1 integrated K-shaped connecting joint
M2 combined K-shaped connecting joint
N base connecting joint
1 inward-flanging C-section steel
2 inward flange of inward-flanging C-section steel
3, 3*a*, 3*b* webs
4 relief hole
5, 5*a* punched or perforated locating groove
6 rear-pressing groove
7 base
8 steel strip
9 reinforcing rib

DESCRIPTION OF THE EMBODIMENTS

Referring to FIG. 1, the BIM-based modular housing built with thin-wall channel steels comprises foundations, columns, beams, walls, a roof plate, doors, windows, stairs and fences.

The beams and columns used in the BIM-based modular housing built with thin-wall channel steels adopt a single layer of inward-flanging C-section steel 1 comprising a web and a bilateral wing plate of which the edge is provided with an inwardly bent inward flange 2.

Figure 9:
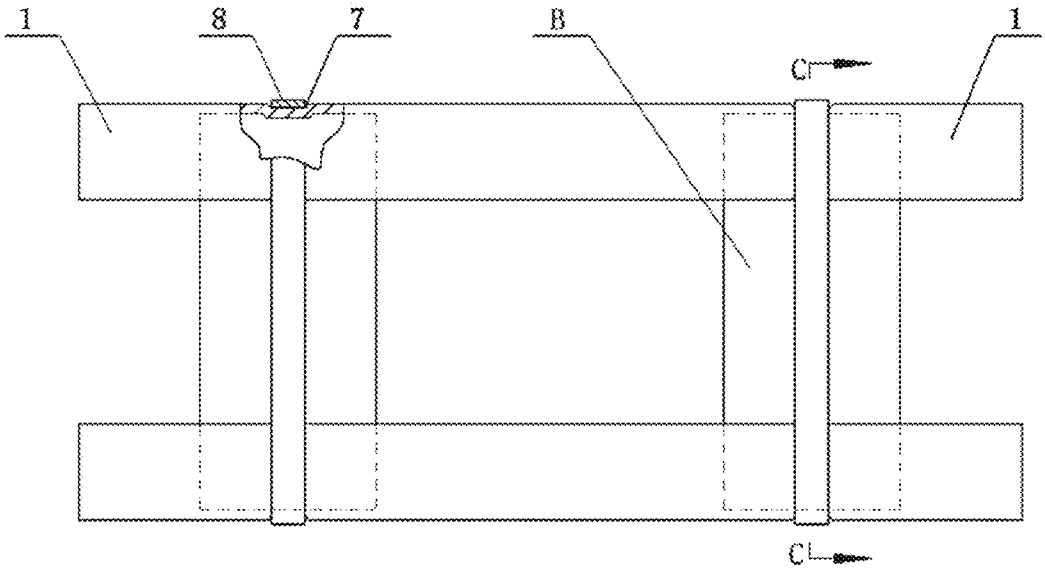
FIG. 9 is a schematic view of the structure of combined square steel arranged by the combination of two inward-flanging C-section steels.
Figure 10:
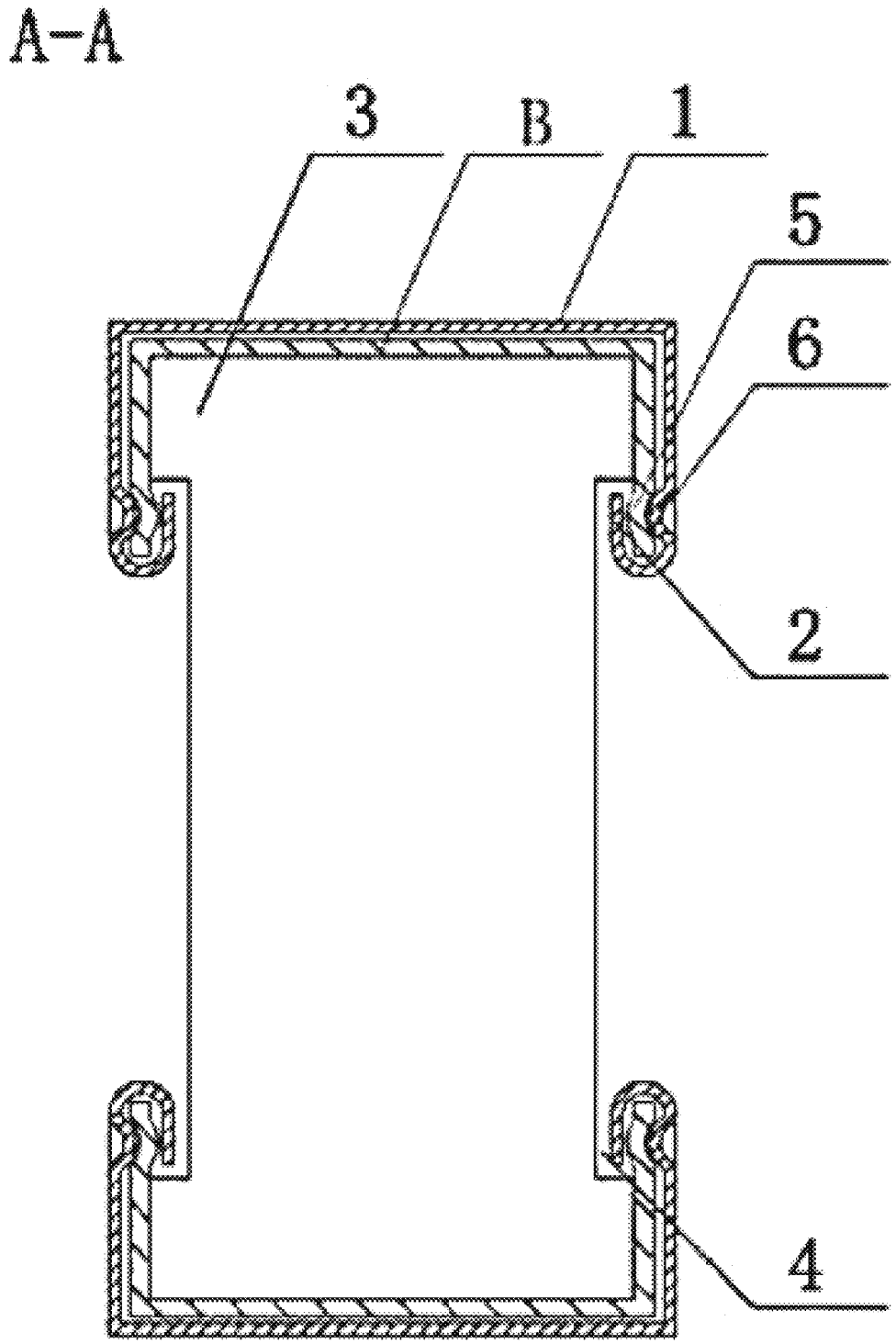
FIG. 10 is a schematic view of the structure of an internal supporting pad of the combined square steel.
Figure 11:
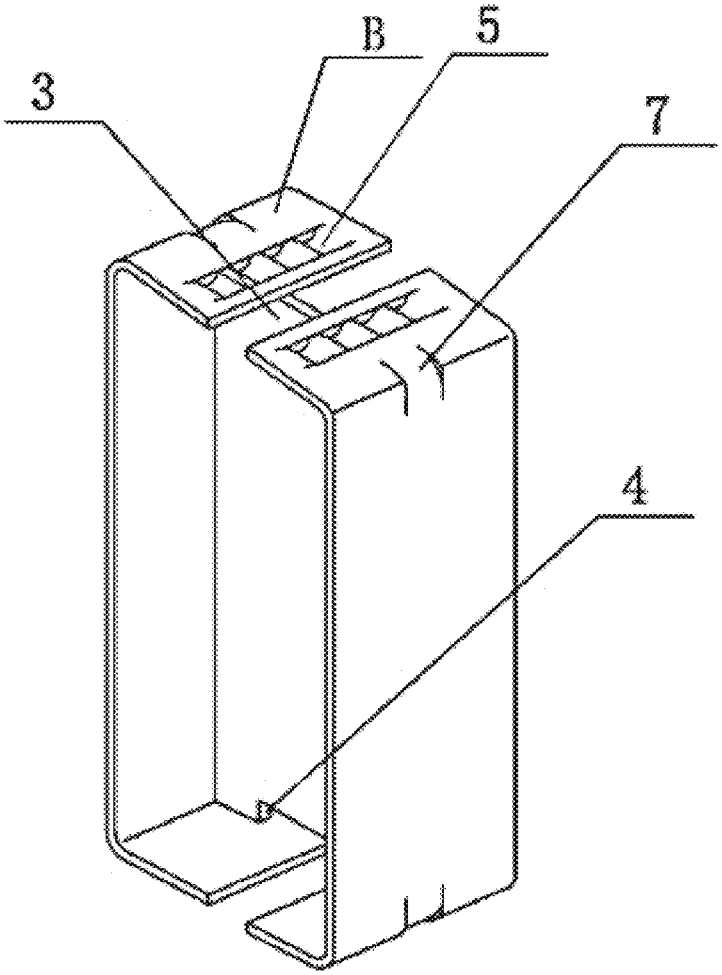
FIG. 11 is a schematic view of the three-dimensional structure of FIG. 10.

Alternatively, the beams and columns used adopt combined square steel arranged by oppositely buckling symmetric inward-flanging C-section steel 1. Referring to FIGS. 9, 10 and 11, the combined square steel comprises two inward-flanging C-section steels 1 which are buckled oppositely and an inner support; the inner support is a web welded in a matched manner inside two C-section steel joints and punched or perforated locating grooves are arranged in the outer surfaces of the two C-section steel joints, respectively; bilateral side-plates of the two C-section steel joints are aligned and there is a gap between the bilateral side-plates, outward-opening relief grooves are arranged in respective web at the gap; an inward flange 2 is arranged at the bilateral wing plate of the inward-flanging C-section steel, respectively; the inward-flanging C-section steel 1 is wrapped outside the inner support and the inward flange 2 is inserted inside the corresponding relief hole in a matched manner; the surface of the inward-flanging C-section steel 1 is provided with rear-pressing grooves which sleeve within the punched or perforated locating grooves in a matched manner; steel strips are bound outside the inward-flanging C-section steel 1 such that the inward-flanging C-section steel 1 is fixed with inner support in a whole; clamping grooves are arranged outside the C-section steel joint at a position corresponding to the web and the steel strip forces the inward-flanging C-section steel 1 to be locally recessed to enter the clamping groove.

Figure 2:
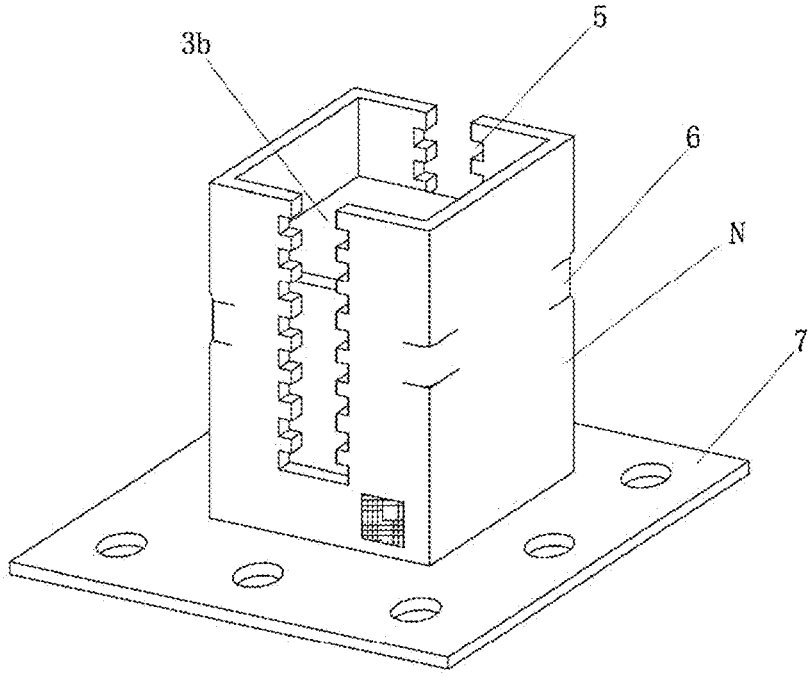
FIG. 2 is a schematic view of the structure of a base connector.

Referring to FIG. 2, the foundations are buried deeply in the ground and butted with respective column by base connectors.

Referring to FIGS. 12 to 32, the beams and columns or the beams are connected to each other together by cross-shaped connectors comprising a cross-shaped connecting joint, a four-way connecting joint made of single channel steel for beam/columns, a three-way connecting joint made of single channel steel for beam/columns, a three-way connecting joint made of dual channel steel for beams/columns, a T-shaped connecting joint made of single channel steel, a six-way connecting joint made of single channel steel mutually perpendicular to each other, a six-way connecting joint made of dual channel steel mutually perpendicular to each other, a slantwise crossed connector, integrated K-shaped connecting joints, combined K-shaped connecting joints, and so on.

Figure 12:
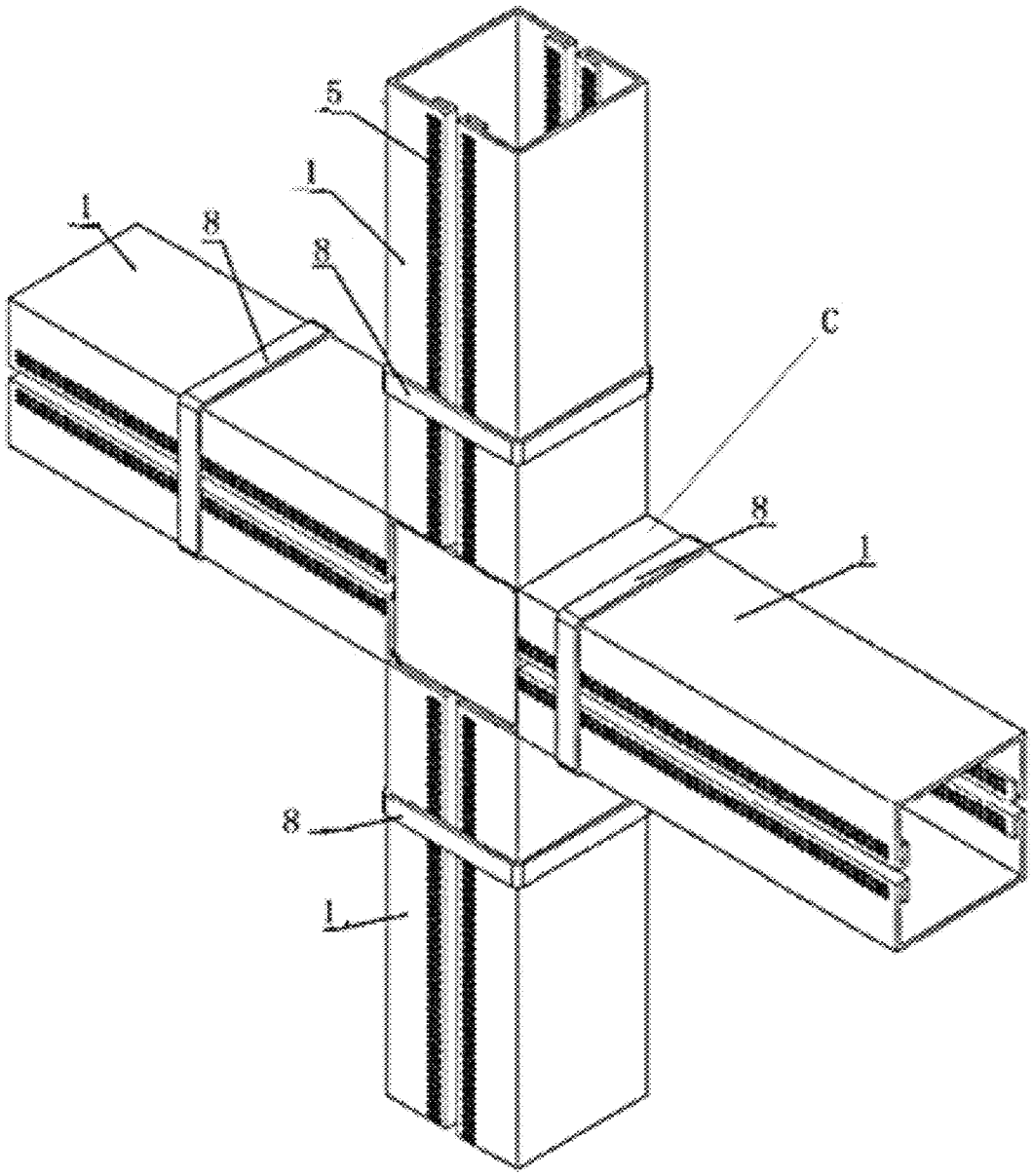
FIG. 12 is a schematic view of the structure of a cross-shaped connecting joint made of dual channel steel.
Figure 13:
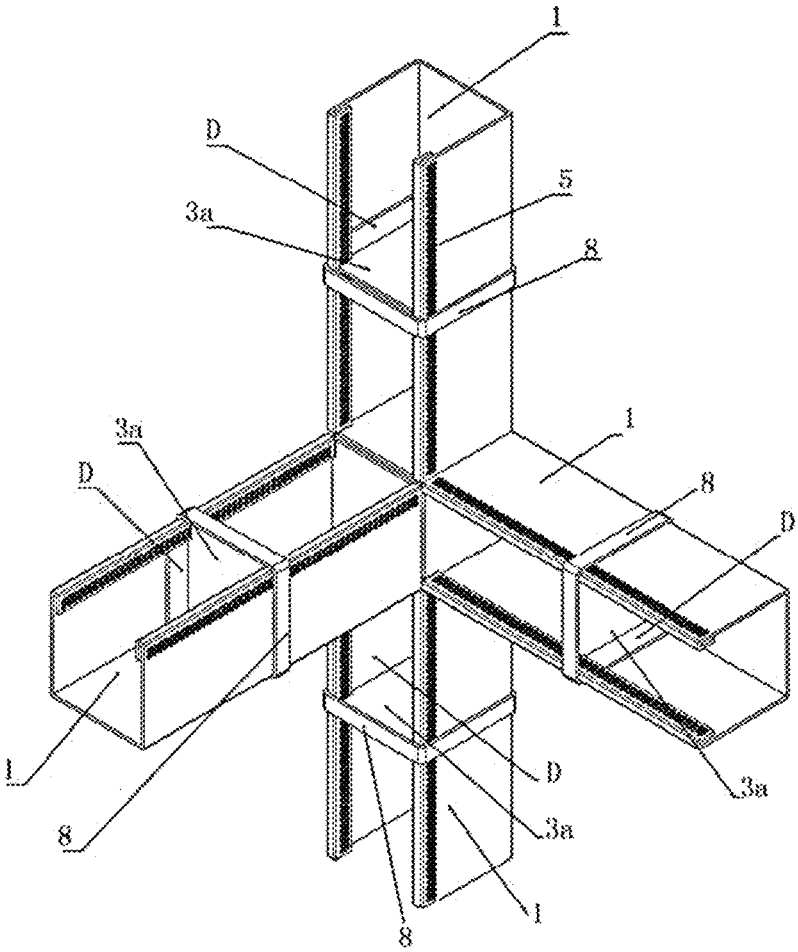
FIG. 13 is a schematic view of the structure of a four-way connecting joint made of single channel steel for the beam/columns.
Figure 14:
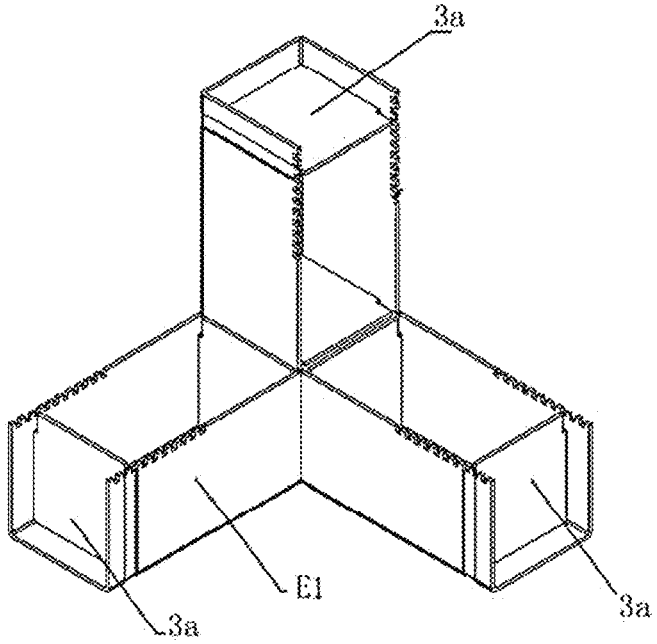
FIG. 14 is a schematic view of the structure of a three-way connecting joint made of single channel steel for the beam/columns.
Figure 15:
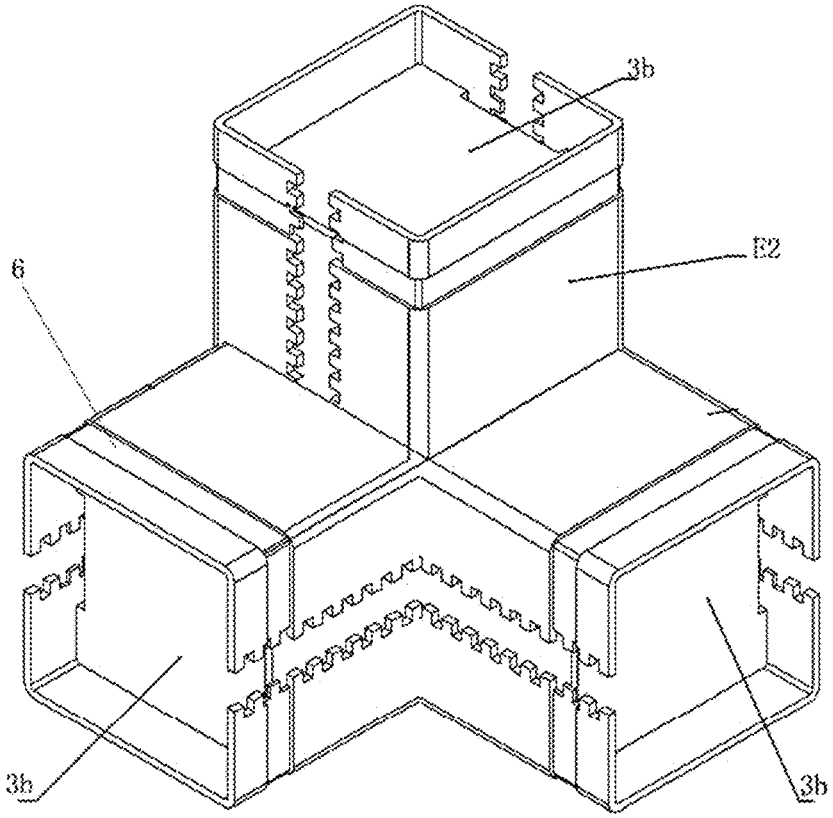
FIG. 15 is a schematic view of the structure of a three-way connecting joint made of dual channel steel for the beams/columns.
Figure 16:
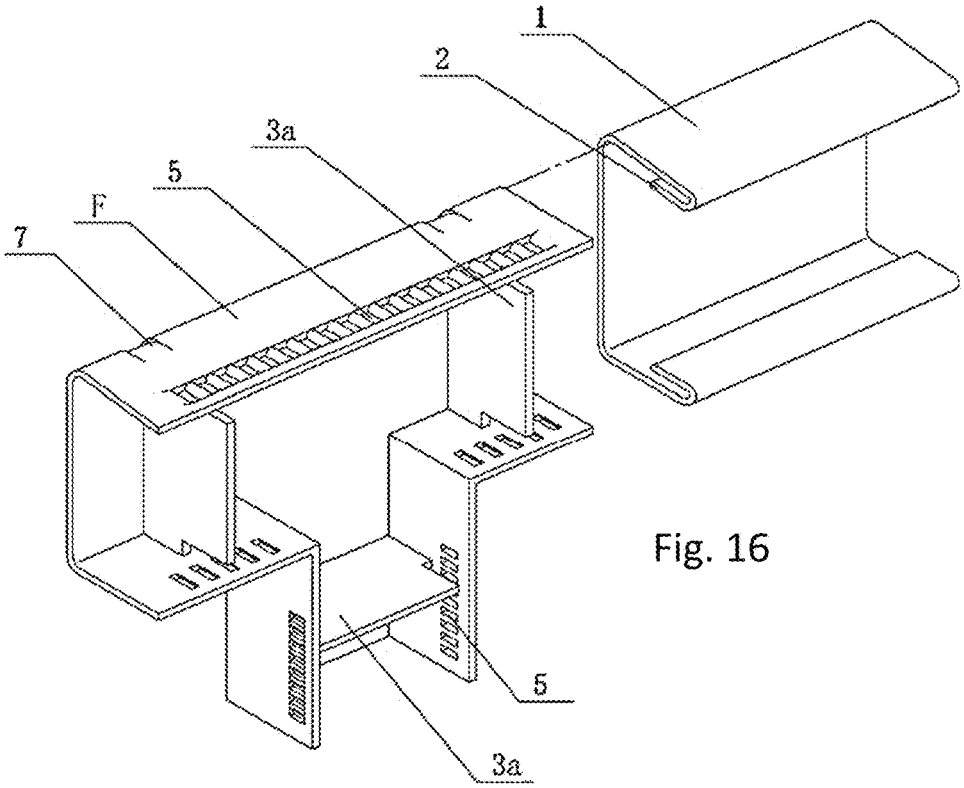
FIG. 16 is a schematic view of the structure of a T-shaped connecting joint made of single channel steel.
Figure 17:
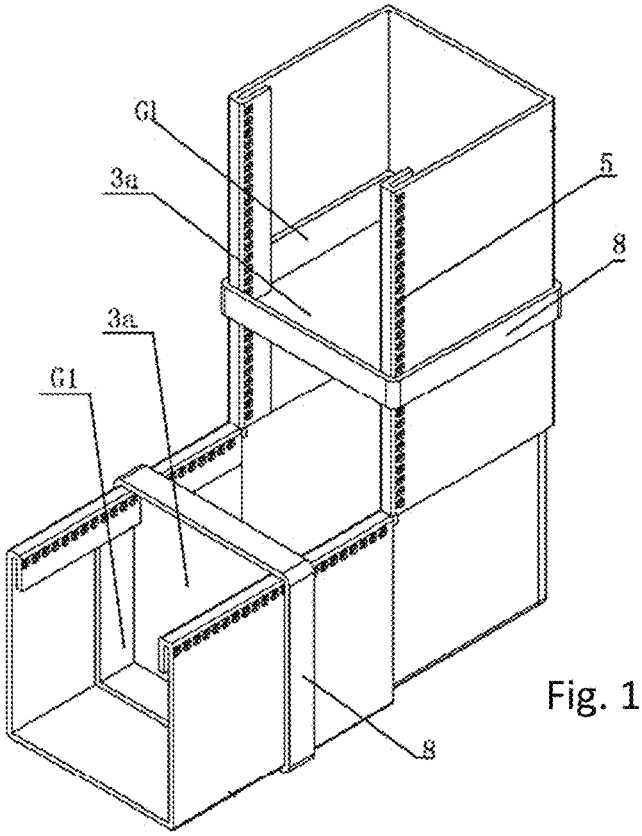
FIG. 17 is a schematic view of the structure of an L-shaped connecting joint made of single channel steel.
Figure 18:
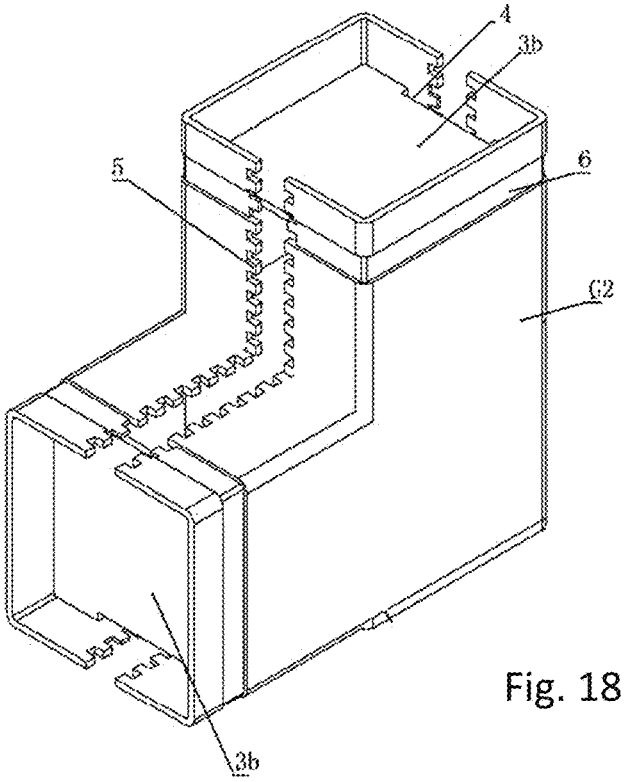
FIG. 18 is a schematic view of the structure of an L-shaped connecting joint made of dual channel steel.
Figure 22:
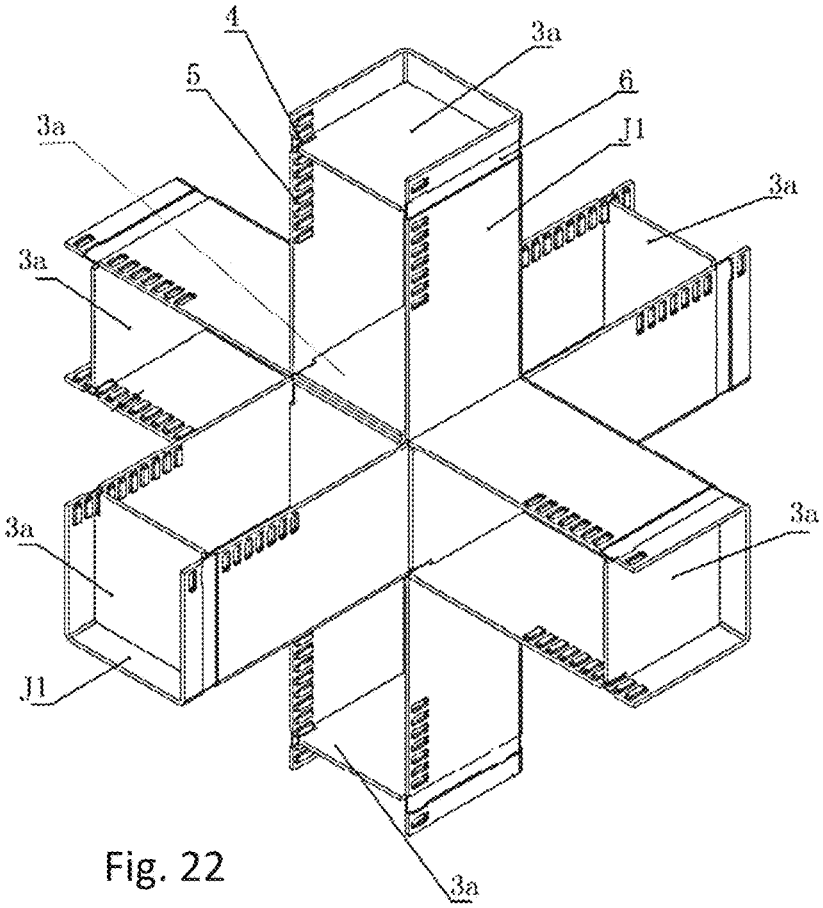
FIG. 22 is a schematic diagram of the structure of a six-way connecting joint made of single channel steel mutually perpendicular to each other.
Figure 23:
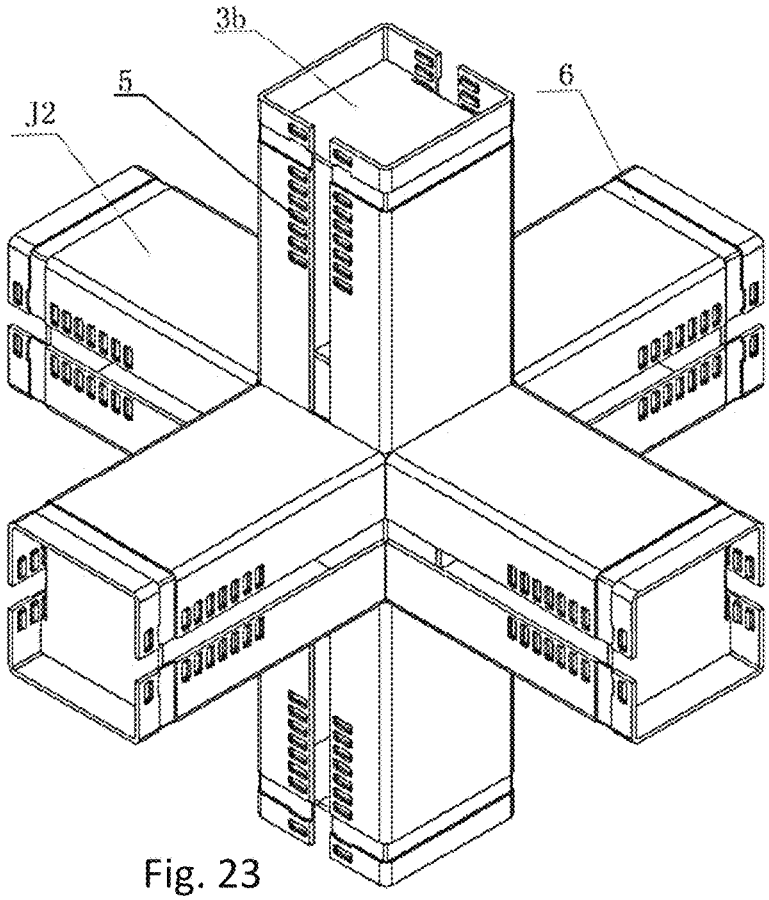
FIG. 23 is a schematic diagram of the structure of a six-way connecting joint made of dual channel steel mutually perpendicular to each other.
Figure 27:
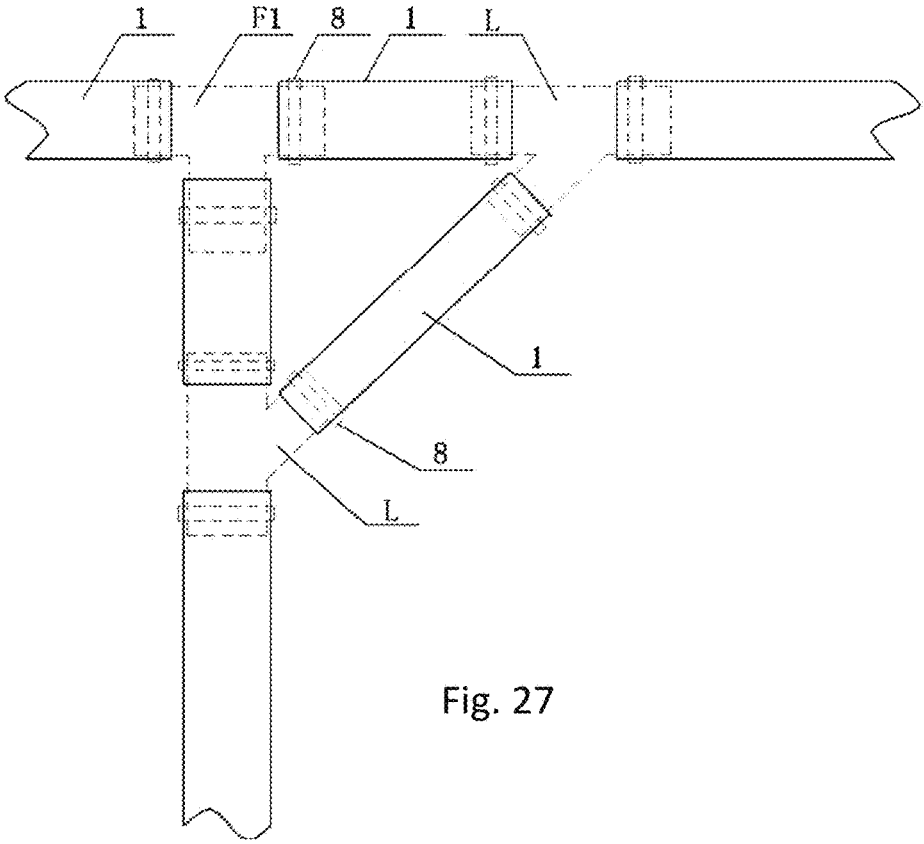
FIG. 27 is a schematic view of the connection structure between reinforcing ribs.
Figure 28:
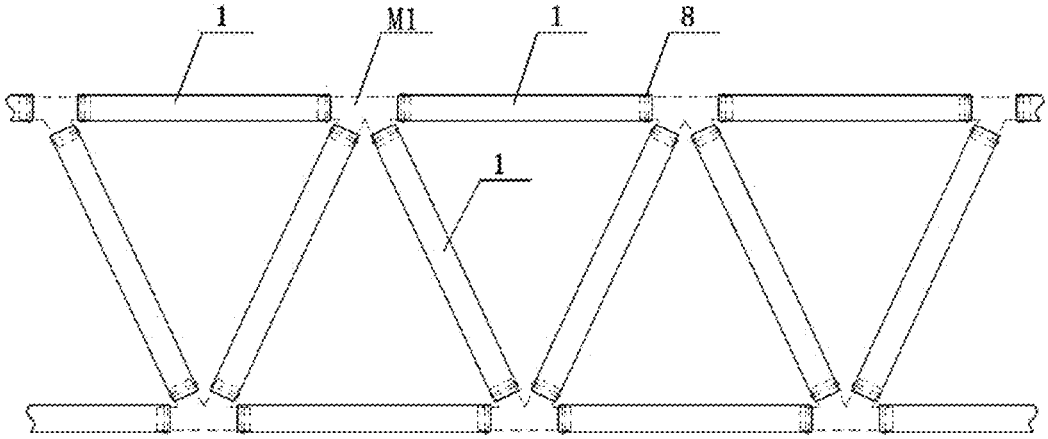
FIG. 28 is a first schematic view of the structure of a combined truss.
Figure 29:
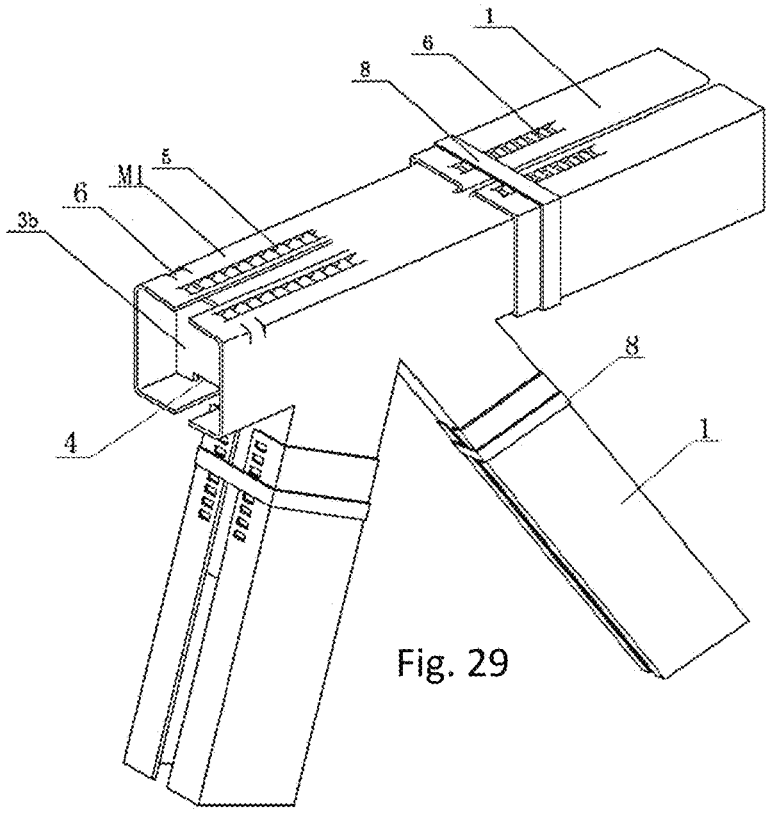
FIG. 29 is a schematic diagram of the structure of the crossed connector in FIG. 28.
Figure 30:
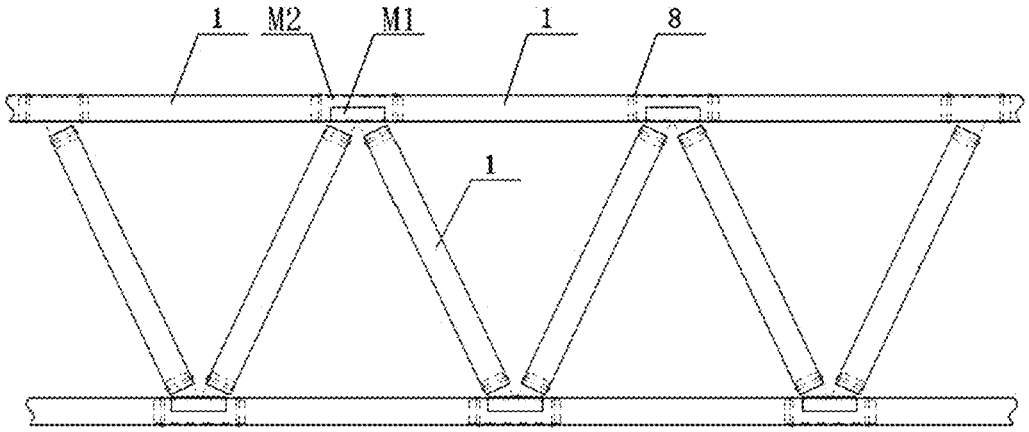
FIG. 30 is a second schematic view of the structure of the combined truss.
Figure 31:
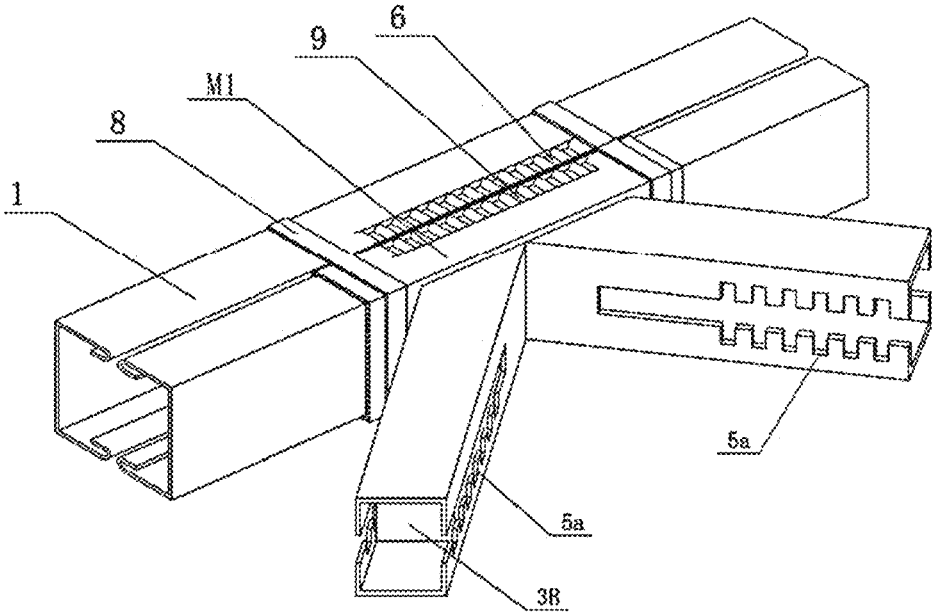
FIG. 31 is a schematic diagram of the structure of a crossed connector in FIG. 30.
Figure 32:
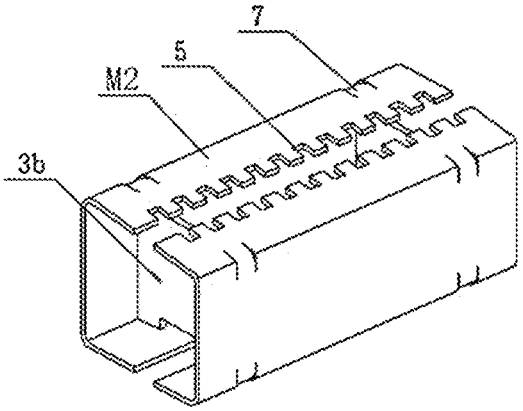
FIG. 32 is a schematic diagram of a base connecting joint.

The columns and beams or beams are connected by a cross-shaped connecting joint, as shown in FIG. 12, or by a four-way connecting joint made of single channel steel for beam/columns as shown in FIG. 13, or by a three-way connecting joint made of single channel steel for beam/columns as shown in FIG. 14, or by a three-way connecting joint made of dual channel steel for beams/columns as shown in FIG. 15, or by a T-shaped connecting joint made of single channel steel as shown in FIG. 16, or by a six-way connecting joint made of single channel steel mutually perpendicular to each other as shown in FIG. 22, or by a six-way connecting joint made of dual channel steel mutually perpendicular to each other as shown in FIG. 23, or by a slantwise crossed connector as shown in FIG. 27, or by integrated K-shaped connecting joints as shown in FIGS. 28 and 29, or by combined K-shaped connecting joints as shown in FIGS. 30, 31 and 32.

Figure 19:
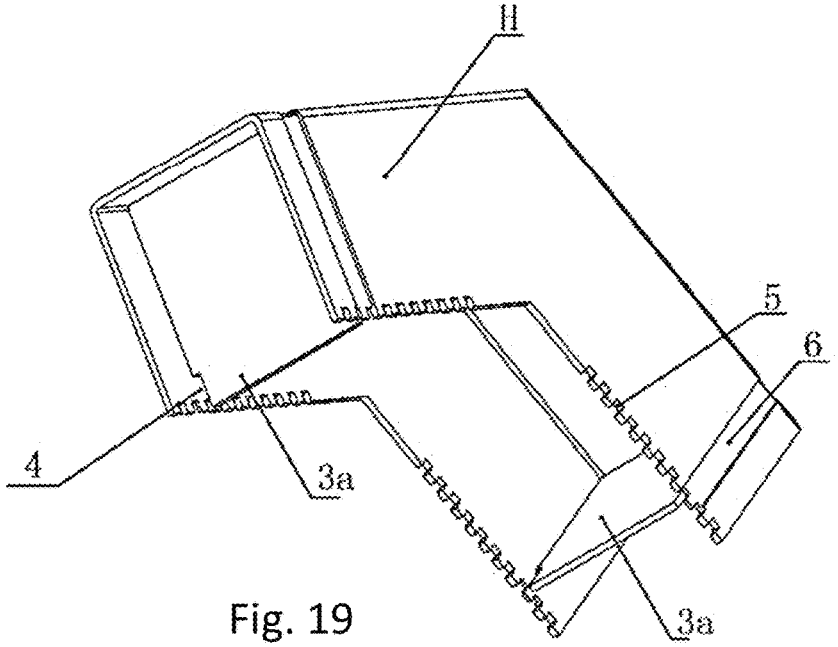
FIG. 19 is a schematic diagram of the structure of a connecting joint made of single channel steel for a ridge.
Figure 20:
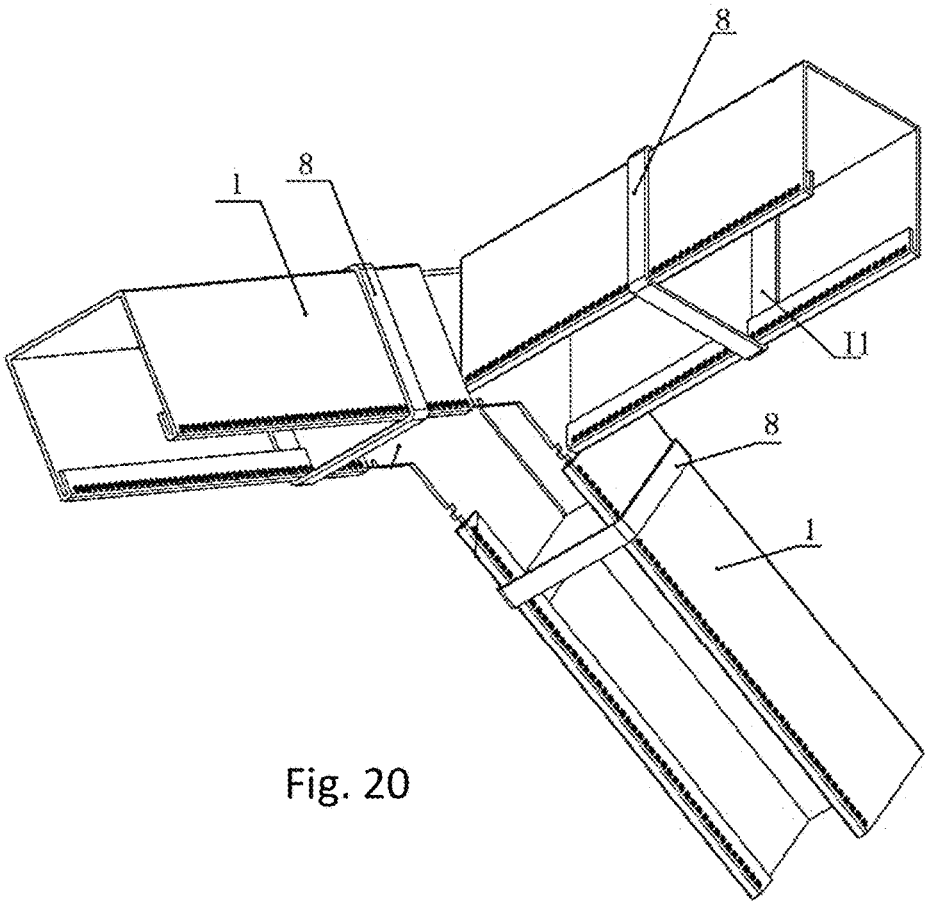
FIG. 20 is a schematic diagram of the structure of a connecting joint made of single channel steel for the ridge and a top beam.
Figure 21:
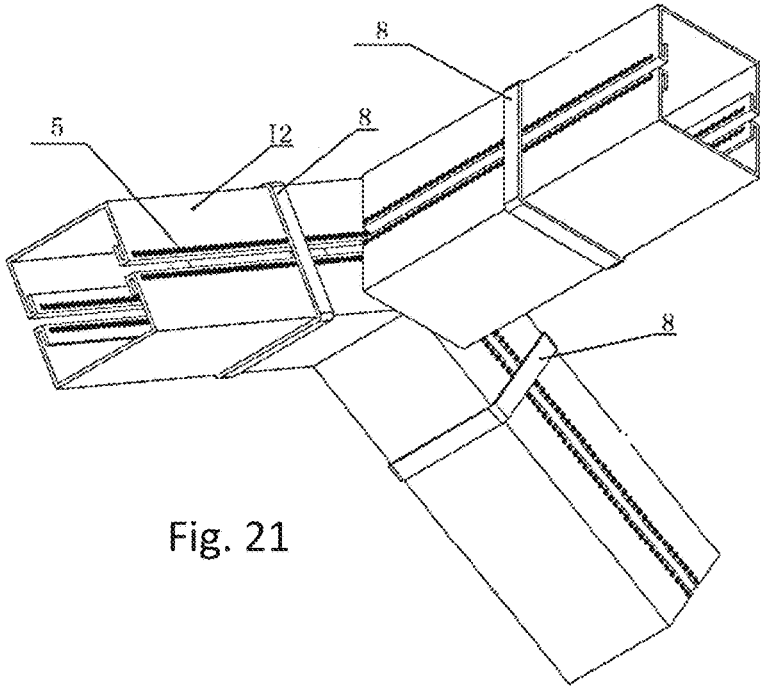
FIG. 21 is a schematic diagram of the structure of a connecting joint made of dual channel steel for the ridge and top beam.

The ridge adopts a ridge made of a single channel steel as shown in FIG. 19, or is connected by a connecting joint made of single channel steel for the ridge and top beam as shown in FIG. 20, or s connected by a connecting joint made of dual channel steel for the ridge and top beam as shown in FIG. 21.

Figure 24:
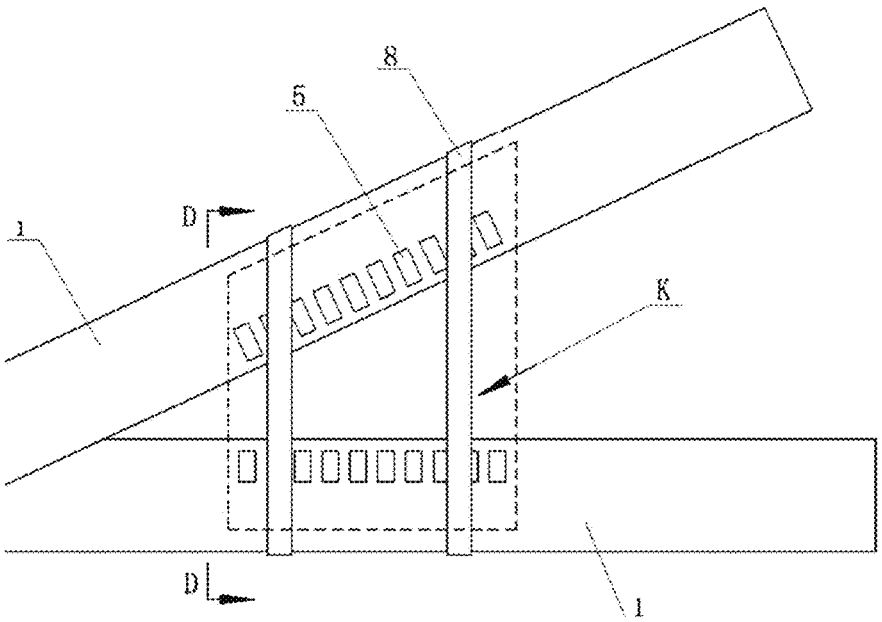
FIG. 24 is a schematic diagram of the connecting joint for the ridge and beams.
Figure 25:
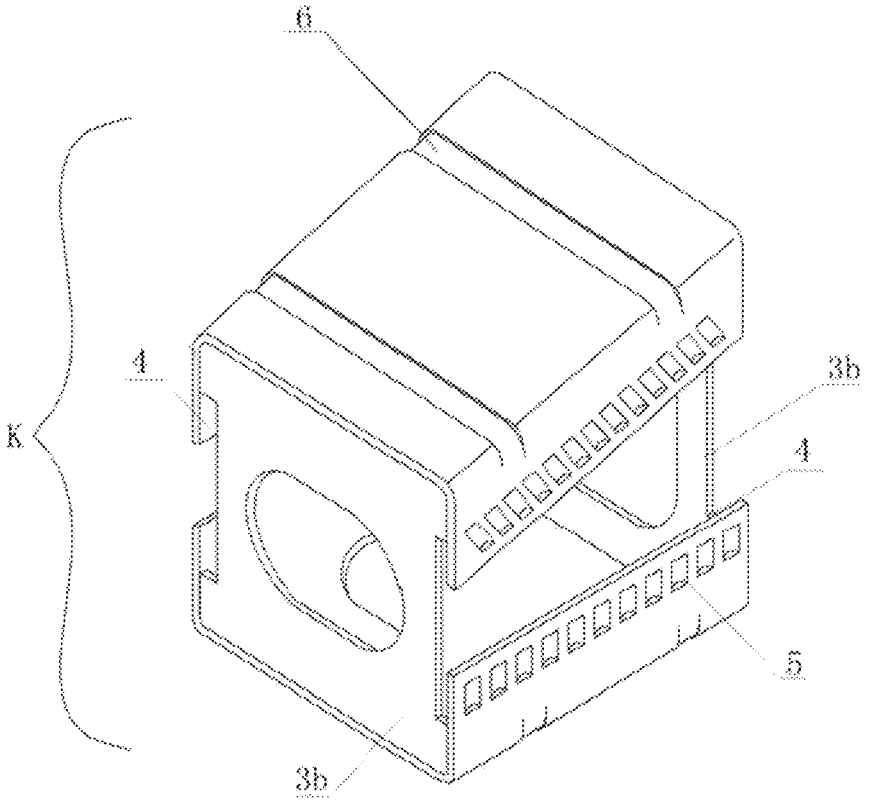
FIG. 25 is a schematic diagram of the connecting joints between the ridge and beams.
Figure 26:
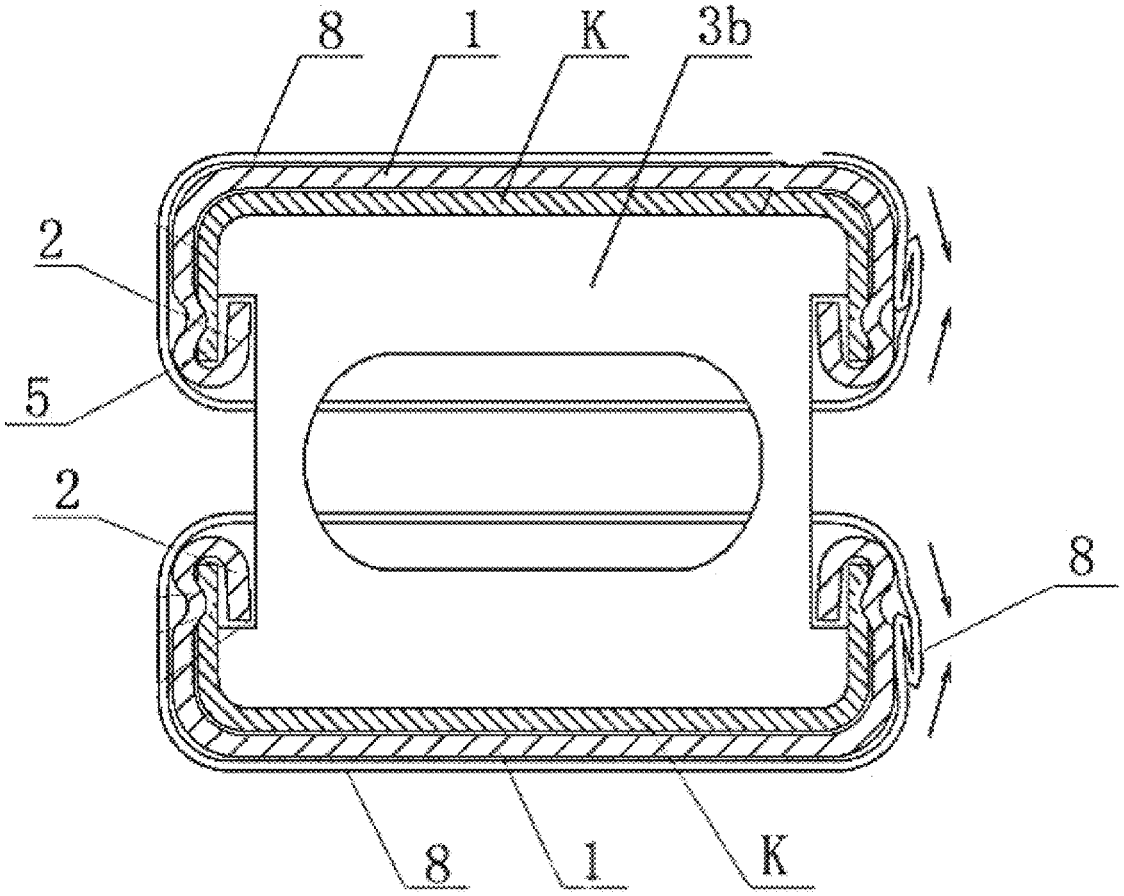
FIG. 26 is a schematic view of a sectional structure of FIG. 25 taken by D-D.

The ridge is connected by a connecting joint for the ridge and beams as shown in FIGS. 24, 25 and 26.

Figure 3:
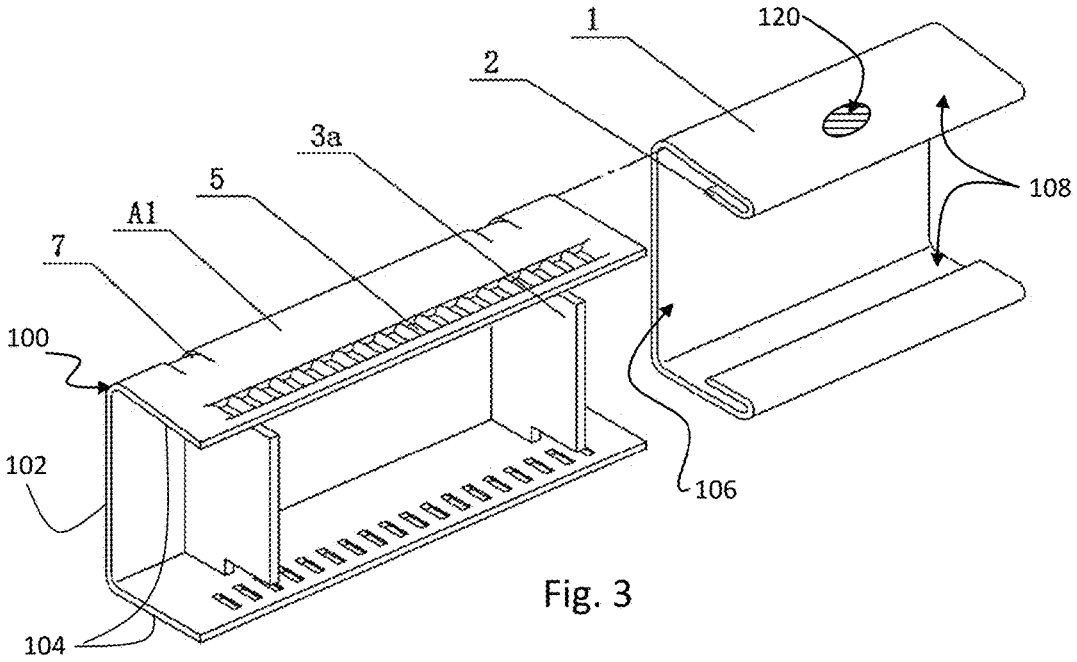
FIG. 3 is a schematic view of the structure of a butting connector made of single channel steel.
Figure 4:
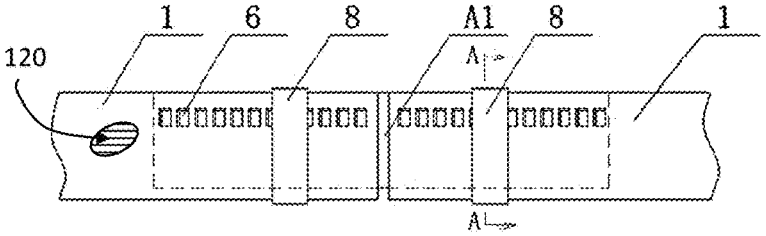
FIG. 4 is a schematic view of the connection structure between the butting connector made of the single channel steel and inward-flanging C-section steel.
Figure 5:
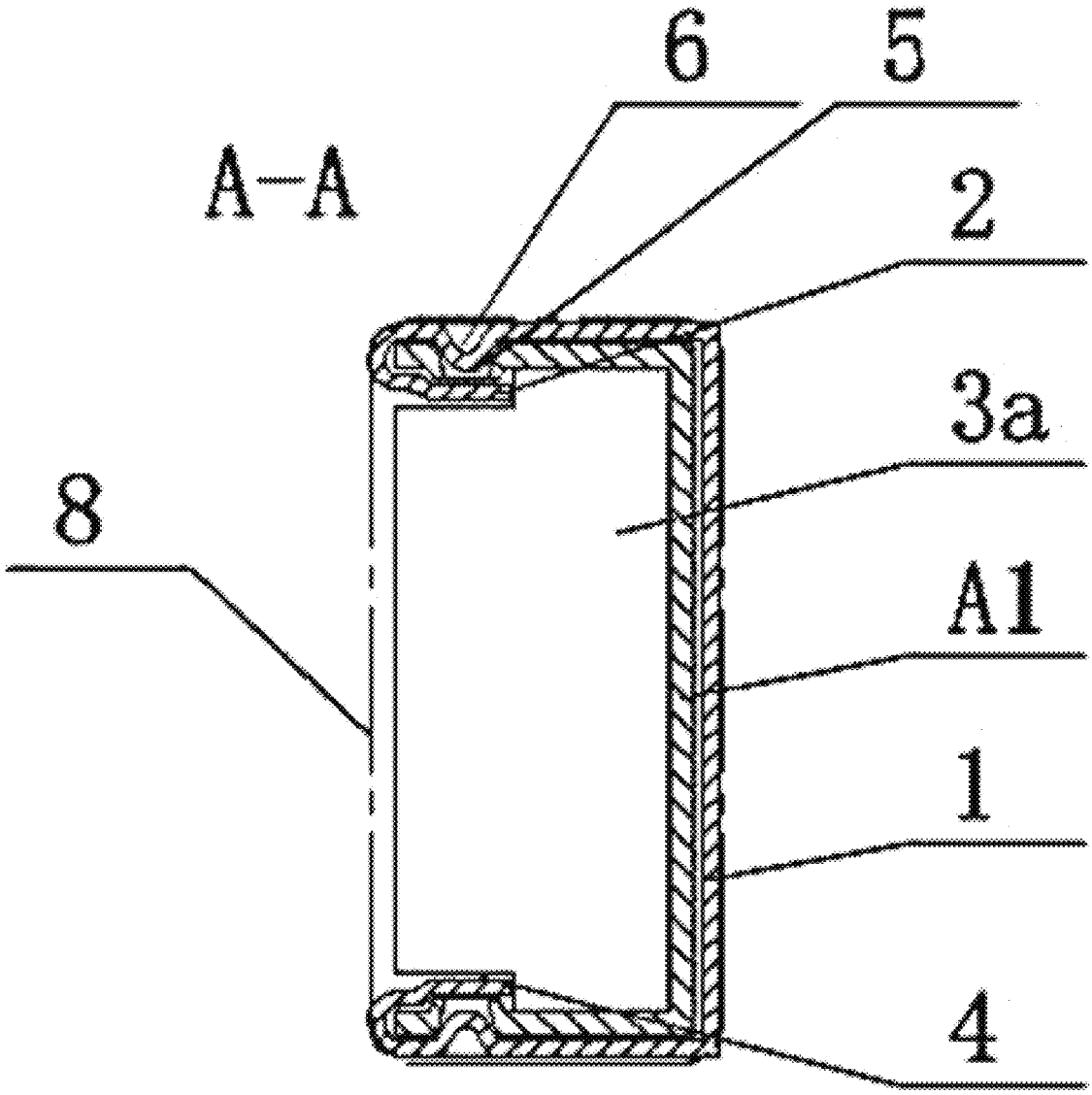
FIG. 5 is a schematic view of a sectional structure of FIG. 4 taken by A-A.
Figure 6:
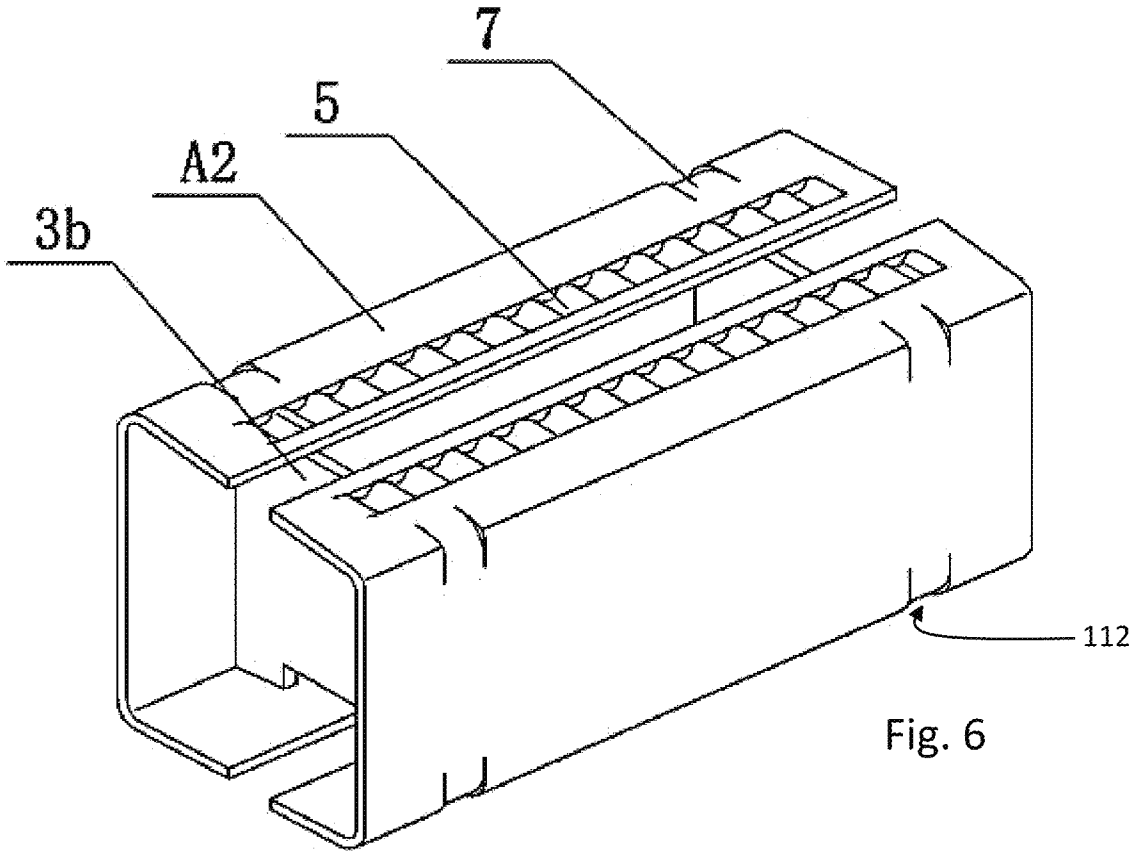
FIG. 6 is a schematic view of the structure of a butting connector made of dual channel steel.
Figure 7:
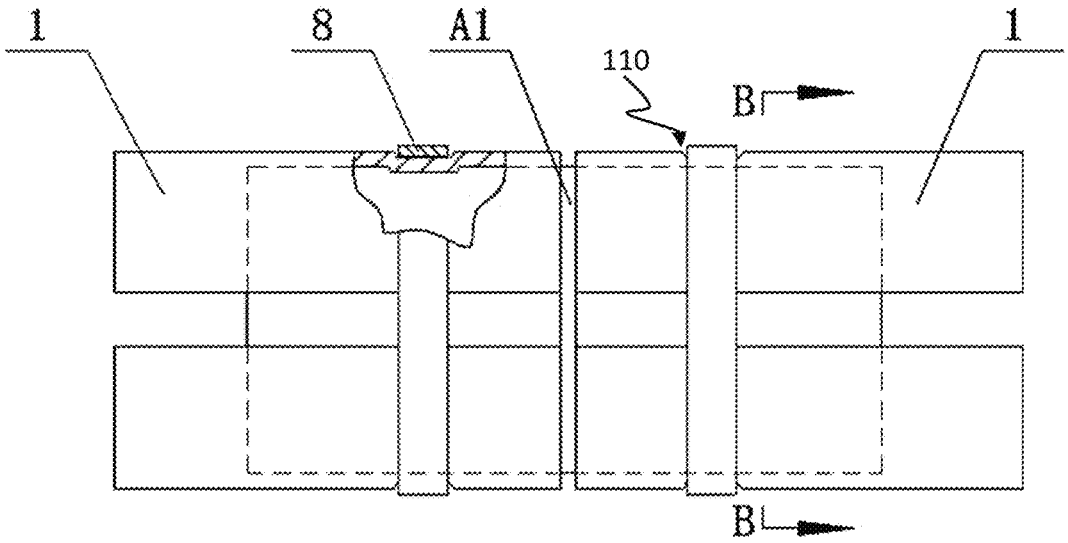
FIG. 7 is a schematic view of the connection structure between the butting connector made of the dual channel steel and inward-flanging C-section steel.
Figure 8:
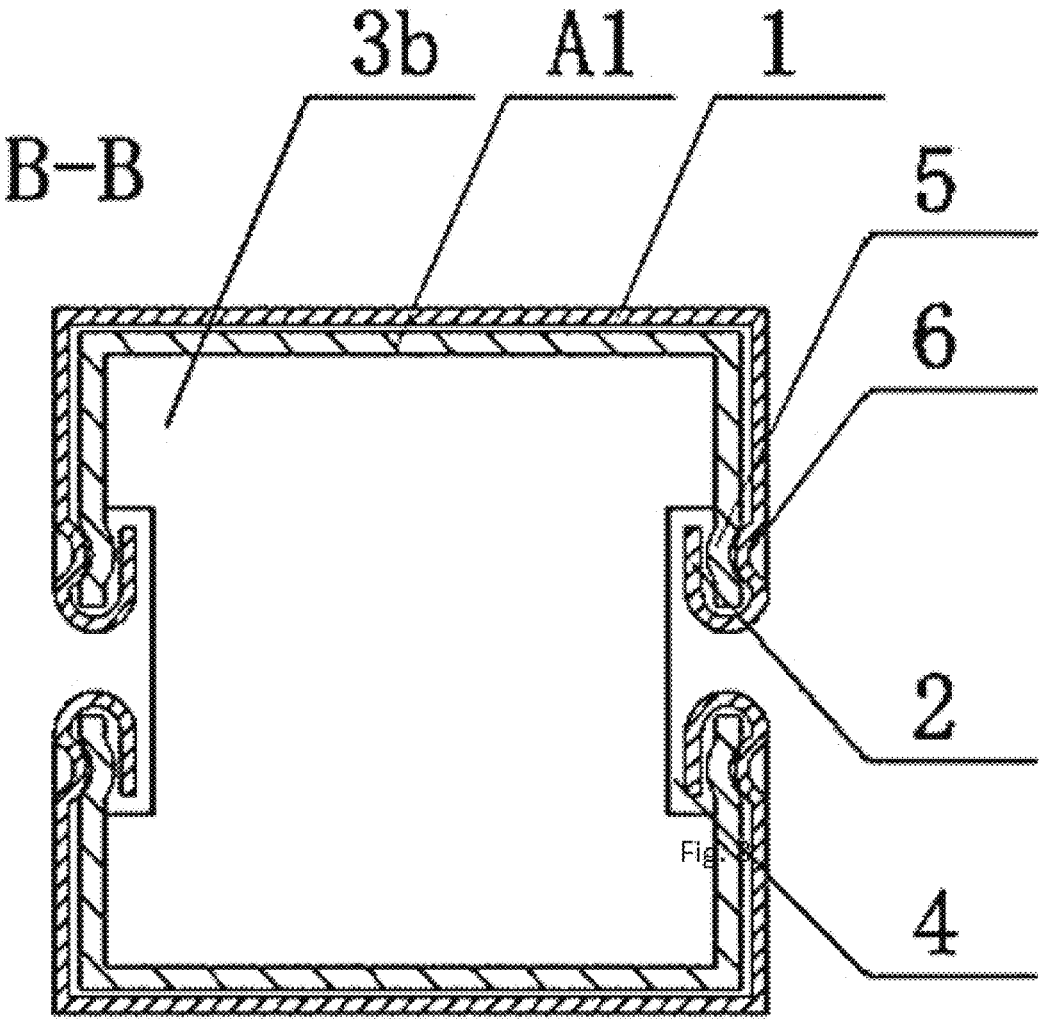
FIG. 8 is a schematic view of a sectional structure of FIG. 7 taken by B-B.

The beams and beams or the columns and columns can be connected by extended connecting joints, i.e., butting connecting joints made of single channel steel as shown in FIGS. 3 to 5 and or butting connecting joints made of dual channel steel as shown in FIGS. 6 to 9.

Each of the base connecting joints, crossed connecting joints, or butting connecting joints, ridge connecting joints and eave connecting joints is provided with a joint comprising a C-section steel and a web, specifically, one C-section steel joint and two C-section steel joints. Punched or perforated locating grooves are arranged at the outside surfaces of the one or two C-section steel joints, respectively. In the case of two C-section steel joints, bilateral side-plates of the two C-section steel joints are aligned and there is a gap between the bilateral side-plates, and outward-opening relief grooves are arranged in respective web at the gap. The inward-flanging C-section steel 1 is wrapped outside one or two C-section steel joints and the inward flange 2 is inserted inside the corresponding relief hole in a matched manner. The surface of the inward-flanging C-section steel 1 is provided with rear-pressing grooves which sleeve within the punched or perforated locating grooves in a matched manner. Steel strips are bound outside the inward-flanging C-section steel 1 such that the inward-flanging C-section steel 1 is fixed with one or two C-section steel joints in a whole; clamping grooves are arranged outside the C-section steel joint at a position corresponding to the web and the steel strip forces the inward-flanging C-section steel 1 to be locally recessed to enter the clamping groove.

Each base connector comprises a base and a connecting joint, one connecting joint is arranged at each of both ends of the butting connectors and the crossed connector is used for fixing at least two connecting joints vertically and slantwise; the connecting joint is arranged by welding at least one horizontal or slant plug, which is groove-shaped, at the sides of the C-section steel joints, the web is welded at the inner sides of the C-section steel joints and slant plug at least at the end position and the punched or perforated locating grooves are arranged at the outside surfaces of the C-section steel joints and slant plug; outward-opening relief grooves are arranged between respective web and bilateral side-plates of the C-section steel joints or the slant plug; and clamping grooves are arranged outside the C-section steel joints and the slant plug at a position corresponding to the web.

Information on a unique name, a unique spatial location, a shape and a material of respective workpiece in a steel structure project, including the information on the unique name, unique spatial location, shape and material of beams, columns and respective connecting joint recorded by BIM information locating pieces, is recorded using the BIM information locating pieces; during the construction, the information included in the BIM information locating pieces on respective workpiece is read by a BIM information scanner to perform the connection and welding construction of respective workpiece in the project.

A butting connecting joint A1 for single thin-wall inward-flanging C-section steel is shown in FIG. 4. The connecting joint is a web welded in a matched manner at least at both ends inside one C-section steel joints, respectively and punched or perforated locating grooves are arranged in the outer surfaces of the C-section steel joints; outward-opening relief grooves 4 are arranged between respective web and bilateral side-plates of the C-section steel joints; and clamping grooves 7 are arranged outside the C-section steel joints and arranged at a position corresponding to the web. Matching weight-reducing holes can also be arranged in the middle of partial web of respective connector so as to further reduce the self-weight of the connector, thereby reduce the self-weight of the housing.

A building information modeling (BIM)-based modular housing built with workpieces made of thin-wall channel steel, the workpieces comprises: a butting connector (A1) having at least one C-section member (100) having a base (102) with two bilateral wing plates (104) being coupled to an edge of at least two web members (3, 3*a*, 3*b*), each bilateral wing plate (104) having an edge with a plurality of locating grooves parallel with the edge, an outside surface of the butting connector (A1) having clamping grooves (112) at each end lateral of a corresponding web member (3, 3*a*, 3*b*); at least two separate inward-flanging C-section members (1) each having a support (106) with two bilateral flanged plates (108) that each have an inwardly bent inward flange (2) and have a plurality of rear pressing members (6) opposite of the inwardly bent inward flange (2), the at least two inward-flanging C-section members (1) being coupled to opposite ends of the at least one corresponding butting connector (A1) by having the base (102) on an inside surface of the support (106) with the two bilateral wing plates (104) on an inside surface of the two bilateral flange plates (108) and with each edge of the two bilateral wing plates (104) within each inward flange (2) so that the plurality of rear pressing members (6) are aligned and pressed into the plurality of locating grooves (5) and so that the inwardly bent inward flange (2) is located within a notch (4) in the edge of the at least two web members (3, 3*a*, 3*b*); at least two straps (8) bounding an outside of the at least one inward-flanging C-section member (1), each strap (8) being positioned within a strap recess (110), such that each strap (8) is lateral to a corresponding clamping groove (112) and web member (3, 3*a*, 3*b*) so as to be bound there around; and a BIM information locating piece (120) on the workpiece, the BIM information locating piece (120) including information with a unique name of the workpiece, a unique spatial location of the workpiece, a shape of the workpiece, and a material of the workpiece, the BIM information locating piece (120) being readable.

The BIM-based modular housing can include a combined squared butting connector (A2) having at least two of the C-section members (100) oppositely positioned relative to the at least two webs (3, 3*a*, 3*b*), each of the C-section members (100) having the base (102) with two bilateral wing plates (104) being coupled to the edge of each of the at least two a web members (3, 3*a*, 3*b*), each bilateral wing plate (104) having the edge with the plurality of locating grooves parallel with the edge, an outside surface of the butting connector (A1) having clamping grooves (112) at each end lateral of a corresponding web member (3, 3*a*, 3*b*), wherein the two bilateral wing plates (104) of each C-section member (100) is pointed at the two bilateral wing plates (104) of the other C-section member (100) with a gap therebetween so as to form a squared cross-sectional profile from two C-section cross-sectional profiles with the gap separating the two C-section members (100).

The BIM-based modular housing of can include: at least two inward-flanging C-section members (1) being coupled to each end of the combined squared butting connector (A2) by having each base (102) on an inside surface of the corresponding support (106) with the corresponding two bilateral wing plates (104) on the corresponding inside surface of the two bilateral flange plates (108) and with each corresponding edge of the two bilateral wing plates (104) within each corresponding inward flange (2) so that the plurality of rear pressing members (6) of each inward-flanged C-section member (1) are aligned and pressed into the plurality of locating grooves (5) of the corresponding combined squared butting connector (A2) and so that two inwardly bent inward flanges (2) of different inward-flanging C-section members (1) are pointing toward each other and located within a single notch (4) in the edge of each of the web members (3, 3*a*, 3*b*).

The BIM-based modular housing can include two inwardly bent inward flanges (2) pointing toward each other being located within a single notch (4) in the edge of the at least two web members (3, 3*a*, 3*b*), wherein each web member (3, 3*a*, 3*b*) includes at least two notches (4), each notch (4) being formed in a side of the edge opposite of the other notch (4).

The BIM-based modular housing can include the at least two straps (8) bound an outside of the combined squared butting connector (A2), each strap (8) being positioned within a strap recess (110), such that each strap (8) is lateral to a corresponding clamping groove (112) and web member (3, 3*a*, 3*b*) so as to be bound there around.

The BIM-based modular housing can include at least one internal supporting pad (B) coupled to and extending between two of the inward-flanging C-section members (1), each internal supporting pad (B) comprising: two of the C-section members (100) oppositely positioned relative to at least one web member (3), each of the C-section members (100) having the base (102) with two bilateral wing plates (104) being coupled to the edge of the at least one web member (3), each bilateral wing plate (104) having the edge with the plurality of locating grooves parallel with the edge, an outside surface of the internal supporting pad (B) having at least one clamping grooves (112) at the at least one web member (3), wherein the two bilateral wing plates (104) of each C-section member (100) is pointed at the two bilateral wing plates (104) of the other C-section member (100) with a gap therebetween so as to form a squared cross-sectional profile from two C-section cross-sectional profiles with the gap separating the two C-section members (100).

The BIM-based modular housing can include: the two inward-flanging C-section members (1) being coupled to each end of the internal supporting pad (B) by having each base (102) on an inside surface of the corresponding support (106) with the corresponding two bilateral wing plates (104) on the corresponding inside surface of the two bilateral flange plates (108) and with each corresponding edge of the two bilateral wing plates (104) within each corresponding inward flange (2) so that the plurality of rear pressing members (6) of each inward-flanged C-section member (1) are aligned and pressed into the plurality of locating grooves (5) of the corresponding internal supporting pad (B) and so that two inwardly bent inward flanges (2) of different inward-flanging C-section members (1) are pointing toward each other and located within a single notch (4) in the edge of the at least one web member (3).

The BIM-based modular housing can include: a cross-shaped connecting joint (C) having four arms, each arm comprising at least two of the C-section members (100) oppositely positioned relative to the at least one web (3, 3*a*, 3*b*), each of the C-section members (100) having the base (102) with two bilateral wing plates (104) being coupled to the edge of each of the at least one web member (3, 3*a*, 3*b*), each bilateral wing plate (104) having the edge with the plurality of locating grooves parallel with the edge, an outside surface of the arm having clamping grooves (112) at each end lateral of the corresponding web member (3, 3*a*, 3*b*), wherein the two bilateral wing plates (104) of each C-section member (100) is pointed at the two bilateral wing plates (104) of the other C-section member (100) with a gap therebetween so as to form a squared cross-sectional profile from two C-section cross-sectional profiles with the gap separating the two C-section members (100).

The BIM-based modular housing can include: at least two inward-flanging C-section members (1) being coupled to each arm of the cross-shaped connecting joint (C) by having each base (102) on an inside surface of the corresponding support (106) with the corresponding two bilateral wing plates (104) on the corresponding inside surface of the two bilateral flange plates (108) and with each corresponding edge of the two bilateral wing plates (104) within each corresponding inward flange (2) so that the plurality of rear pressing members (6) of each inward-flanged C-section member (1) are aligned and pressed into the plurality of locating grooves (5) of the corresponding combined squared butting connector (A2) and so that two inwardly bent inward flanges (2) of different inward-flanging C-section members (1) are pointing toward each other.

The BIM-based modular housing can include a four-way connecting joint (D) comprising four arms, each arm comprising: an internal support having at least one C-section member (100) having a base (102) with two bilateral wing plates (104) being coupled to an edge of a web member (3*a*), each bilateral wing plate (104) having an edge with a plurality of locating grooves parallel with the edge, an outside surface of the arm having clamping grooves (112) at each end lateral of a corresponding web member (3*a*); an inward-flanging C-section member (1) having a support (106) with two bilateral flanged plates (108) that each have an inwardly bent inward flange (2) and have a plurality of rear pressing members (6) opposite of the inwardly bent inward flange (2), the at least two inward-flanging C-section members (1) being coupled to the corresponding internal support by having the base (102) on an inside surface of the support (106) with the two bilateral wing plates (104) on an inside surface of the two bilateral flange plates (108) and with each edge of the two bilateral wing plates (104) within each inward flange (2) so that the plurality of rear pressing members (6) are aligned and pressed into the plurality of locating grooves (5) and so that the inwardly bent inward flange (2) is located within a notch (4) in the edge of the web member (3*a*); a strap (8) bounding an outside of the inward-flanging C-section member (1), the strap (8) being positioned within a strap recess (110), such that each strap (8) is lateral to the corresponding clamping groove (112) and web member (3*a*) so as to be bound there around.

The BIM-based modular housing can include a three-way connecting joint (D) comprising three arms, each arm comprising: an internal support having at least one C-section member (100) having a base (102) with two bilateral wing plates (104) being coupled to an edge of a web member (3*a*), each bilateral wing plate (104) having an edge with a plurality of locating grooves parallel with the edge, an outside surface of the arm having clamping grooves (112) at each end lateral of a corresponding web member (3*a*); an inward-flanging C-section member (1) having a support (106) with two bilateral flanged plates (108) that each have an inwardly bent inward flange (2) and have a plurality of rear pressing members (6) opposite of the inwardly bent inward flange (2), the at least two inward-flanging C-section members (1) being coupled to the corresponding internal support by having the base (102) on an inside surface of the support (106) with the two bilateral wing plates (104) on an inside surface of the two bilateral flange plates (108) and with each edge of the two bilateral wing plates (104) within each inward flange (2) so that the plurality of rear pressing members (6) are aligned and pressed into the plurality of locating grooves (5) and so that the inwardly bent inward flange (2) is located within a notch (4) in the edge of the web member (3*a*); a strap (8) bounding an outside of the inward-flanging C-section member (1), the strap (8) being positioned within a strap recess (110), such that each strap (8) is lateral to the corresponding clamping groove (112) and web member (3*a*) so as to be bound there around.

The BIM-based modular housing can include a multi-way connecting joint, the multi-way connecting joint having a plurality of arms, each arm comprising: an internal support having at least one C-section member (100) having a base (102) with two bilateral wing plates (104) being coupled to an edge of a web member (3*a*), each bilateral wing plate (104) having an edge with a plurality of locating grooves parallel with the edge, an outside surface of the arm having clamping grooves (112) at each end lateral of a corresponding web member (3*a*); an inward-flanging C-section member (1) having a support (106) with two bilateral flanged plates (108) that each have an inwardly bent inward flange (2) and have a plurality of rear pressing members (6) opposite of the inwardly bent inward flange (2), the at least two inward-flanging C-section members (1) being coupled to the corresponding internal support by having the base (102) on an inside surface of the support (106) with the two bilateral wing plates (104) on an inside surface of the two bilateral flange plates (108) and with each edge of the two bilateral wing plates (104) within each inward flange (2) so that the plurality of rear pressing members (6) are aligned and pressed into the plurality of locating grooves (5) and so that the inwardly bent inward flange (2) is located within a notch (4) in the edge of the web member (3*a*); a strap (8) bounding an outside of the inward-flanging C-section member (1), the strap (8) being positioned within a strap recess (110), such that each strap (8) is lateral to the corresponding clamping groove (112) and web member (3*a*) so as to be bound there around.

The BIM-based modular housing can include a multi-way connecting joint, the multi-way connecting joint having a plurality of arms, each arm comprising: an internal support having two C-section members (100) each having a base (102) with two bilateral wing plates (104) being coupled to an edge of a web member (3) opposite of each other, each bilateral wing plate (104) having an edge with a plurality of locating grooves parallel with the edge, an outside surface of the arm having clamping grooves (112) at each end lateral of a corresponding web member (3); two inward-flanging C-section members (1) each having a support (106) with two bilateral flanged plates (108) that each have an inwardly bent inward flange (2) and have a plurality of rear pressing members (6) opposite of the inwardly bent inward flange (2), the two inward-flanging C-section members (1) being coupled to the corresponding internal support by having the base (102) on an inside surface of the support (106) with the two bilateral wing plates (104) on an inside surface of the two bilateral flange plates (108) and with each edge of the two bilateral wing plates (104) within each inward flange (2) so that the plurality of rear pressing members (6) are aligned and pressed into the plurality of locating grooves (5) and so that the inwardly bent inward flange (2) is located within a notch (4) in the edge of the web member (3); and a strap (8) bounding an outside of the inward-flanging C-section member (1), the strap (8) being positioned within a strap recess (110), such that each strap (8) is lateral to the corresponding clamping groove (112) and web member (3) so as to be bound there around.

The BIM-based modular housing can include a corner connecting joint, the corner connecting joint having two arms at an angle with respect to each other, each arm comprising: an internal support having at least one C-section member (100) having a base (102) with two bilateral wing plates (104) being coupled to an edge of a web member (3*a*), each bilateral wing plate (104) having an edge with a plurality of locating grooves parallel with the edge, an outside surface of the arm having clamping grooves (112) at each end lateral of a corresponding web member (3*a*); an inward-flanging C-section member (1) having a support (106) with two bilateral flanged plates (108) that each have an inwardly bent inward flange (2) and have a plurality of rear pressing members (6) opposite of the inwardly bent inward flange (2), the at least two inward-flanging C-section members (1) being coupled to the corresponding internal support by having the base (102) on an inside surface of the support (106) with the two bilateral wing plates (104) on an inside surface of the two bilateral flange plates (108) and with each edge of the two bilateral wing plates (104) within each inward flange (2) so that the plurality of rear pressing members (6) are aligned and pressed into the plurality of locating grooves (5) and so that the inwardly bent inward flange (2) is located within a notch (4) in the edge of the web member (3*a*); a strap (8) bounding an outside of the inward-flanging C-section member (1), the strap (8) being positioned within a strap recess (110), such that each strap (8) is lateral to the corresponding clamping groove (112) and web member (3*a*) so as to be bound there around.

The BIM-based modular housing can include a corner connecting joint, the corner connecting joint having two arms at an angle with respect to each other, each arm comprising: an internal support having two C-section members (100) each having a base (102) with two bilateral wing plates (104) being coupled to an edge of a web member (3) opposite of each other, each bilateral wing plate (104) having an edge with a plurality of locating grooves parallel with the edge, an outside surface of the arm having clamping grooves (112) at each end lateral of a corresponding web member (3); two inward-flanging C-section members (1) each having a support (106) with two bilateral flanged plates (108) that each have an inwardly bent inward flange (2) and have a plurality of rear pressing members (6) opposite of the inwardly bent inward flange (2), the two inward-flanging C-section members (1) being coupled to the corresponding internal support by having the base (102) on an inside surface of the support (106) with the two bilateral wing plates (104) on an inside surface of the two bilateral flange plates (108) and with each edge of the two bilateral wing plates (104) within each inward flange (2) so that the plurality of rear pressing members (6) are aligned and pressed into the plurality of locating grooves (5) and so that the inwardly bent inward flange (2) is located within a notch (4) in the edge of the web member (3); and a strap (8) bounding an outside of the inward-flanging C-section member (1), the strap (8) being positioned within a strap recess (110), such that each strap (8) is lateral to the corresponding clamping groove (112) and web member (3) so as to be bound there around.

The BIM-based modular housing can include a multi-way connecting joint, the multi-way connecting joint having a plurality of arms, each arm comprising: a C-section member (100) having a base (102) with two bilateral wing plates (104) being coupled to an edge of a web member (3*a*), each bilateral wing plate (104) having an edge with a plurality of locating grooves parallel with the edge, an outside surface of the arm having clamping grooves (112) at each end lateral of a corresponding web member (3*a*).

The BIM-based modular housing can include a multi-way connecting joint, the multi-way connecting joint having a plurality of arms, each arm comprising: an internal support having two C-section members (100) each having a base (102) with two bilateral wing plates (104) being coupled to an edge of a web member (3) opposite of each other, each bilateral wing plate (104) having an edge with a plurality of locating grooves parallel with the edge, an outside surface of the arm having clamping grooves (112) at each end lateral of a corresponding web member (3).

A BIM-based modular housing system can include: a BIM-based modular housing; and a BIM information scanner that is configured to scan and record the BIM information locating piece (120).

A method of recording the BIM information locating piece can include: providing the BIM-based modular housing system; identifying a first BIM information locating piece: and scanning and recording the BIM information locating piece (120) with the BIM information scanner.

What is claimed is:

1. A building information modeling (BIM)-based modular housing built with workpieces made of thin-wall channel steel, the workpieces comprising:

a butting connector having at least one C-section member having a base with two bilateral wing plates being coupled to an edge of at least two web members, each bilateral wing plate having an edge with a plurality of locating grooves parallel with the edge, an outside surface of the butting connector having clamping grooves at each end lateral of a corresponding web member;

at least two separate inward-flanging C-section members each having a support with two bilateral flanged plates that each have an inwardly bent inward flange and have a plurality of rear pressing members opposite of the inwardly bent inward flange, the at least two inward-flanging C-section members being coupled to opposite ends of the at least one corresponding butting connector by having the base on an inside surface of the support with the two bilateral wing plates on an inside surface of the two bilateral flange plates and with each edge of the two bilateral wing plates within each inward flange so that the plurality of rear pressing members are aligned and pressed into the plurality of locating grooves and so that the inwardly bent inward flange is located within a notch in the edge of the at least two web members;

at least two straps bounding an outside of the at least one inward-flanging C-section member, each strap being positioned within a strap recess, such that each strap is lateral to a corresponding clamping groove and web member so as to be bound there around; and a BIM information locating piece on the workpiece, the BIM information locating piece including information with a unique name of the workpiece, a unique spatial location of the workpiece, a shape of the workpiece, and a material of the workpiece, the BIM information locating piece being readable.

2. The BIM-based modular housing of claim 1, further comprising a combined squared butting connector having at least two of the C-section members oppositely positioned relative to the at least two webs, each of the C-section members having the base with two bilateral wing plates being coupled to the edge of each of the at least two web members, each bilateral wing plate having the edge with the plurality of locating grooves parallel with the edge, an outside surface of the butting connector having clamping grooves at each end lateral of a corresponding web member, wherein the two bilateral wing plates of each C-section member is pointed at the two bilateral wing plates of the other C-section member with a gap therebetween so as to form a squared cross-sectional profile from two C-section cross-sectional profiles with the gap separating the two C-section members.

3. The BIM-based modular housing of claim 2, further comprising:

at least two inward-flanging C-section members being coupled to each end of the combined squared butting connector by having each base on an inside surface of the corresponding support with the corresponding two bilateral wing plates on the corresponding inside surface of the two bilateral flange plates and with each corresponding edge of the two bilateral wing plates within each corresponding inward flange so that the plurality of rear pressing members of each inward-flanged C-section member are aligned and pressed into the plurality of locating grooves of the corresponding combined squared butting connector and so that two inwardly bent inward flanges of different inward-flanging C-section members are pointing toward each other and located within a single notch in the edge of each of the web members.

4. The BIM-based modular housing of claim 3, further comprising two inwardly bent inward flanges pointing toward each other being located within a single notch in the edge of the at least two web members, wherein each web member includes at least two notches, each notch being formed in a side of the edge opposite of the other notch.

5. The BIM-based modular housing of claim 3, wherein the at least two straps bound an outside of the combined squared butting connector, each strap being positioned within a strap recess, such that each strap is lateral to a corresponding clamping groove and web member so as to be bound there around.

6. The BIM-based modular housing of claim 5, further comprising at least one internal supporting pad coupled to and extending between two of the inward-flanging C-section members, each internal supporting pad comprising:

two of the C-section members oppositely positioned relative to at least one web member, each of the C-section members having the base with two bilateral wing plates being coupled to the edge of the at least one web member, each bilateral wing plate having the edge with the plurality of locating grooves parallel with the edge, an outside surface of the internal supporting pad having at least one clamping grooves at the at least one web member, wherein the two bilateral wing plates of each C-section member is pointed at the two bilateral wing plates of the other C-section member with a gap therebetween so as to form a squared cross-sectional profile from two C-section cross-sectional profiles with the gap separating the two C-section members.

7. The BIM-based modular housing of claim 6, further comprising:

the two inward-flanging C-section members being coupled to each end of the internal supporting pad by having each base on an inside surface of the corresponding support with the corresponding two bilateral wing plates on the corresponding inside surface of the two bilateral flange plates and with each corresponding edge of the two bilateral wing plates within each corresponding inward flange so that the plurality of rear pressing members of each inward-flanged C-section member are aligned and pressed into the plurality of locating grooves of the corresponding internal supporting pad and so that two inwardly bent inward flanges of different inward-flanging C-section members are pointing toward each other and located within a single notch in the edge of the at least one web member.

8. The BIM-based modular housing of claim 3, further comprising a cross-shaped connecting joint having four arms, each arm comprising at least two of the C-section members oppositely positioned relative to the at least one web member, each of the C-section members having the base with two bilateral wing plates being coupled to the edge of each of the at least one web member, each bilateral wing plate having the edge with the plurality of locating grooves parallel with the edge, an outside surface of the arm having clamping grooves at each end lateral of the corresponding web member, wherein the two bilateral wing plates of each C-section member is pointed at the two bilateral wing plates of the other C-section member with a gap therebetween so as to form a squared cross-sectional profile from two C-section cross-sectional profiles with the gap separating the two C-section members.

9. The BIM-based modular housing of claim 8, further comprising:

at least two inward-flanging C-section members being coupled to each arm of the cross-shaped connecting joint by having each base on an inside surface of the corresponding support with the corresponding two bilateral wing plates on the corresponding inside surface of the two bilateral flange plates and with each corresponding edge of the two bilateral wing plates within each corresponding inward flange so that the plurality of rear pressing members of each inward-flanged C-section member are aligned and pressed into the plurality of locating grooves of the corresponding combined squared butting connector and so that two inwardly bent inward flanges of different inward-flanging C-section members are pointing toward each other.

10. The BIM-based modular housing of claim 1, further comprising a four-way connecting joint comprising four arms, each arm comprising:

an internal support having at least one C-section member having a base with two bilateral wing plates being coupled to an edge of a web member, each bilateral wing plate having an edge with a plurality of locating grooves parallel with the edge, an outside surface of the arm having clamping grooves at each end lateral of a corresponding web member;

an inward-flanging C-section member having a support with two bilateral flanged plates that each have an inwardly bent inward flange and have a plurality of rear pressing members opposite of the inwardly bent inward flange, the at least two inward-flanging C-section members being coupled to the corresponding internal support by having the base on an inside surface of the support with the two bilateral wing plates on an inside surface of the two bilateral flange plates and with each edge of the two bilateral wing plates within each inward flange so that the plurality of rear pressing members are aligned and pressed into the plurality of locating grooves and so that the inwardly bent inward flange is located within a notch in the edge of the web member; and a strap bounding an outside of the inward-flanging C-section member, the strap being positioned within a strap recess, such that each strap is lateral to the corresponding clamping groove and web member so as to be bound there around.

11. The BIM-based modular housing of claim 1, further comprising a three-way connecting joint comprising three arms, each arm comprising:

an internal support having at least one C-section member having a base with two bilateral wing plates being coupled to an edge of a web member, each bilateral wing plate having an edge with a plurality of locating grooves parallel with the edge, an outside surface of the arm having clamping grooves at each end lateral of a corresponding web member;

an inward-flanging C-section member having a support with two bilateral flanged plates that each have an inwardly bent inward flange and have a plurality of rear pressing members opposite of the inwardly bent inward flange, the at least two inward-flanging C-section members being coupled to the corresponding internal support by having the base on an inside surface of the support with the two bilateral wing plates on an inside surface of the two bilateral flange plates and with each edge of the two bilateral wing plates within each inward flange so that the plurality of rear pressing members are aligned and pressed into the plurality of locating grooves and so that the inwardly bent inward flange is located within a notch in the edge of the web member;

a strap bounding an outside of the inward-flanging C-section member, the strap being positioned within a strap recess, such that each strap is lateral to the corresponding clamping groove and web member so as to be bound there around.

12. The BIM-based modular housing of claim 1, further comprising a multi-way connecting joint, the multi-way connecting joint having a plurality of arms, each arm comprising:

an internal support having at least one C-section member having a base with two bilateral wing plates being coupled to an edge of a web member, each bilateral wing plate having an edge with a plurality of locating grooves parallel with the edge, an outside surface of the arm having clamping grooves at each end lateral of a corresponding web member;

an inward-flanging C-section member having a support with two bilateral flanged plates that each have an inwardly bent inward flange and have a plurality of rear pressing members opposite of the inwardly bent inward flange, the at least two inward-flanging C-section members being coupled to the corresponding internal support by having the base on an inside surface of the support with the two bilateral wing plates on an inside surface of the two bilateral flange plates and with each edge of the two bilateral wing plates within each inward flange so that the plurality of rear pressing members are aligned and pressed into the plurality of locating grooves and so that the inwardly bent inward flange is located within a notch in the edge of the web member;

a strap bounding an outside of the inward-flanging C-section member, the strap being positioned within a strap recess, such that each strap is lateral to the corresponding clamping groove and web member so as to be bound there around.

13. The BIM-based modular housing of claim 3, further comprising a multi-way connecting joint, the multi-way connecting joint having a plurality of arms, each arm comprising:

an internal support having two C-section members each having a base with two bilateral wing plates being coupled to an edge of a web member opposite of each other, each bilateral wing plate having an edge with a plurality of locating grooves parallel with the edge, an outside surface of the arm having clamping grooves at each end lateral of a corresponding web member;

two inward-flanging C-section members each having a support with two bilateral flanged plates that each have an inwardly bent inward flange and have a plurality of rear pressing members opposite of the inwardly bent inward flange, the two inward-flanging C-section members being coupled to the corresponding internal support by having the base on an inside surface of the support with the two bilateral wing plates on an inside surface of the two bilateral flange plates and with each edge of the two bilateral wing plates within each inward flange so that the plurality of rear pressing members are aligned and pressed into the plurality of locating grooves and so that the inwardly bent inward flange is located within a notch in the edge of the web member; and a strap bounding an outside of the inward-flanging C-section member, the strap being positioned within a strap recess, such that each strap is lateral to the corresponding clamping groove and web member so as to be bound there around.

14. The BIM-based modular housing of claim 1, further comprising a corner connecting joint, the corner connecting joint having two arms at an angle with respect to each other, each arm comprising:

an internal support having at least one C-section member having a base with two bilateral wing plates being coupled to an edge of a web member, each bilateral wing plate having an edge with a plurality of locating grooves parallel with the edge, an outside surface of the arm having clamping grooves at each end lateral of a corresponding web member;

an inward-flanging C-section member having a support with two bilateral flanged plates that each have an inwardly bent inward flange and have a plurality of rear pressing members opposite of the inwardly bent inward flange, the at least two inward-flanging C-section members being coupled to the corresponding internal support by having the base on an inside surface of the support with the two bilateral wing plates on an inside surface of the two bilateral flange plates and with each edge of the two bilateral wing plates within each inward flange so that the plurality of rear pressing members are aligned and pressed into the plurality of locating grooves and so that the inwardly bent inward flange s located within a notch in the edge of the web member;

a strap bounding an outside of the inward-flanging C-section member, the strap being positioned within a strap recess, such that each strap is lateral to the corresponding clamping groove and web member so as to be bound there around.

15. The BIM-based modular housing of claim 3, further comprising a corner connecting joint, the corner connecting joint having two arms at an angle with respect to each other, each arm comprising:

an internal support having two C-section members each having a base with two bilateral wing plates being coupled to an edge of a web member opposite of each other, each bilateral wing plate having an edge with a plurality of locating grooves parallel with the edge, an outside surface of the arm having clamping grooves at each end lateral of a corresponding web member;

two inward-flanging C-section members each having a support with two bilateral flanged plates that each have an inwardly bent inward flange and have a plurality of rear pressing members opposite of the inwardly bent inward flange, the two inward-flanging C-section members being coupled to the corresponding internal support by having the base on an inside surface of the support with the two bilateral wing plates on an inside surface of the two bilateral flange plates and with each edge of the two bilateral wing plates within each inward flange so that the plurality of rear pressing members are aligned and pressed into the plurality of locating grooves and so that the inwardly bent inward flange is located within a notch in the edge of the web member; and a strap bounding an outside of the inward-flanging C-section member, the strap being positioned within a strap recess, such that each strap is lateral to the corresponding clamping groove and web member so as to be bound there around.

16. The BIM-based modular housing of claim 1, further comprising a multi-way connecting joint, the multi-way connecting joint having a plurality of arms, each arm comprising:

a C-section member having a base with two bilateral wing plates being coupled to an edge of a web member, each bilateral wing plate having an edge with a plurality of locating grooves parallel with the edge, an outside surface of the arm having clamping grooves at each end lateral of a corresponding web member.

17. The BIM-based modular housing of claim 3, further comprising a multi-way connecting joint, the multi-way connecting joint having a plurality of arms, each arm comprising:

an internal support having two C-section members each having a base with two bilateral wing plates being coupled to an edge of a web member opposite of each other, each bilateral wing plate having an edge with a plurality of locating grooves parallel with the edge, an outside surface of the arm having clamping grooves at each end lateral of a corresponding web member.

18. A BIM-based modular housing system comprising:

the BIM-based modular housing of claim 1; and a BIM information scanner that is configured to scan and record the BIM information locating piece.

19. A method of recording the BIM information locating piece, the method comprising:

providing the BIM-based modular housing system of claim 18;

identifying a first BIM information locating piece: and scanning and recording the BIM information locating piece with the BIM information scanner.

* * * * *